United States Patent [19]

Isoard

[11] 4,007,882

[45] Feb. 15, 1977

[54] APPARATUS FOR THE AUTOMATIC DOFFING OF TEXTILE MACHINES SUCH AS WINDING MACHINES

[75] Inventor: Bernard Isoard, Ecully, France

[73] Assignee: Rhone-Poulenc-Textile, Paris, France

[22] Filed: Apr. 10, 1975

[21] Appl. No.: 566,811

[30] Foreign Application Priority Data

Apr. 11, 1974 France ..... 74.13119
Aug. 18, 1974 France ..... 74.28648

[52] U.S. Cl. ..... 242/18 R; 242/35.5 A
[51] Int. Cl.[2] ..... B65H 54/02
[58] Field of Search ..... 242/18 R, 18 PW, 35.5 A

[56] References Cited

UNITED STATES PATENTS

| | | | |
|---|---|---|---|
| 3,428,266 | 2/1969 | Emery | 242/18 PW |
| 3,811,631 | 5/1974 | Mayer et al. | 242/18 R |
| 3,820,730 | 6/1974 | Endo et al. | 242/35.5 A |
| 3,908,918 | 9/1975 | Bergstrom | 242/18 PW |

*Primary Examiner*—William D. Martin, Jr.
*Attorney, Agent, or Firm*—Sherman & Shalloway

[57] ABSTRACT

Apparatus for automatic bobbin changing on a high speed frontal bobbin winder with at least one winding-up station, at least one yarn support gripping spindle with a horizontal axis, a rotatable winding cylinder mounted for movement into and out of tangential engagement with a package forming on a yarn support on said spindle, a fixed yarn guide and a reciprocable yarn guide for distributing yarn along the yarn support, said apparatus comprising, mounted on a frame, a loading and unloading means including at least two parallel spindles, one of said spindles for removing a wound yarn package from the gripping spindle and another spindle for placing an empty yarn support on said gripping spindle, said parallel spindles being movable in turn into an aligned position in axial alignment with a gripping spindle of the machine;

nozzle means for capturing and removing the yarn fed to the yarn support, said nozzle means having a rectilinear capture slit communicating with a channel through which a stream of fluid may be fed at high speed and means for cutting the yarn associated with said nozzle means;

means for mounting the nozzle means so that it is movable between a capture position in which the slit extends in a plane including the reciprocating yarn between the fixed guide and the reciprocable guide, to capture a yarn as it moves from the fixed guide to the reciprocable guide and a second position adjacent said aligned position, to engage the captured yarn on an empty yarn support carried by said gripping spindle.

21 Claims, 29 Drawing Figures

APPARATUS FOR THE AUTOMATIC DOFFING OF TEXTILE MACHINES SUCH AS WINDING MACHINES

BACKGROUND OF THE INVENTION

The invention relates in particular to an apparatus for effecting automatic bobbin-changing on winding-up machines or bobbin-winders possessing at least one horizontal yarn support on which the yarn, delivered continuously, is wound up at high speed. By "high speed", there are to be understood speeds which can be much as 6,000 to 7,000 meters/minute and more.

Automatic bobbin-winders provided with individual bobbin-changing means are known. French application No. 2,168,645 relates to a bobbin-winder provided with a longitudinally slit tube for effecting pneumatic conveying, which makes it possible for the yarn to be conveyed towards a waste receptacle when the support is being changed. Moreover, means for removing the full bobbin and placing the empty bobbin in position are integrated into the actual structure of the bobbin-winder. This system leads to a particular design of the bobbin-winder, which has three spindles for mounting bobbins, each of them being used in turn to form a single bobbin at a time.

The investment in equipment is high and this equipment is unused for a considerable proportion of the time. Moreover, the failure of any one of the bobbin-changing components makes it necessary to stop the bobbin-winder which cannot operate under manual control.

A bobbin-winder equipped with bobbin-changing means is also known from U.S. Pat. No. 3,761,029 in which two yarn supports are alternately in contact with a winding cylinder and which possesses an associated transfer device equipped with pneumatic means for temporarily removing the yarn to a waste receptacle and for passing it from the full bobbin to the empty bobbin while forming an attachment tail. The bobbin-changing operation involves a manual sequence for removing the full bobbin and placing the empty bobbin in position.

French Pat. No. 2,105,351 relates to a device for effecting the entirely automatic changing of yarn packages on a texturizing loom. It consists of a movable assembly which travels along the loom like a carriage and serves all the winding-up positions of the loom. The device includes means for removing the full bobbin, means for placing an empty bobbin in position and means which continuously remove the yarn to a waste receptacle when the bobbin is being changed, in order to prevent the yarn from remaining in the ovens for a long time, as this could damage the yarn. The removal means consist of a nozzle which is mounted so that it can move and which can suck up a yarn, remove it temporarily to a wate receptacle and then anchor it on the empty bobbin. This device avoids the disadvantages of prior art devices, because a single device serves a large number of winding-up positions. However, the yarn comes under the control of the removal nozzle after contact between the package and the drive or winding cylinder has ceased and after the yarn has been removed from the reciprocating guide. The nozzle thus acts on a yarn which is no longer pulled. This device, which was investigated on a texturizing loom where the maximum winding-up speed (not indicated in the patent) is approximately 400 to 500 meters/minute.

French Pat. No. 2,027,080 describes an automatic bobbin-changing apparatus which can serve several rows of bobbin-winders. The apparatus has means which make it possible automatically to remove the full bobbin and place an empty bobbin in position, means for gripping the yarn and removing it to the waste receptacle when the bobbin is being changed, and means for transferring the yarn onto the empty bobbin. The means for gripping and removing the yarn comprise a capture head provided with a cutting device and means for sucking up the yarn, acting at the level where the yarn sweeps a triangular area, that is to say between the last fixed guide and the reciprocating guide for effecting distribution of the yarn on the bobbin. The head travels in a direction which is substantially perpendicular to the plane of movement of the yarn, and the yarn enters a cavity provided in the head and is then cut and thereafter sucked towards the waste receptacle. It is found that the yarn is gripped, after the cutting operation, on an end which is no longer pulled, and this is incompatible with high speeds of delivery of the yarn. Furthermore, what is involved is a device for effecting bobbin-changing on a bobbin-winder where the yarn is wound up at a speed of 150 meters/minute, under a tension, of 1 gram. Moreover, the bobbin-winder has a special structure according to which the receiving bobbin is rotated via its ends by means of rollers.

French Pat. No. 2,098,134 relates to a method and apparatus for effecting bobbin-changing on a bobbin-winder. Bobbin-changing means are mounted in a stationary manner at each winding-up position. The apparatus has a fixed nozzle for gripping the yarn, the nozzle being provided with a capture slit and acting at the level where the yarn sweeps a triangular area as above. In operation, contact between the coil and the winding cylinder is first stopped and the nozzle then comes into action again. The nozzle thus acts on a loose yarn which is no longer pulled. This principle can be applied only at low winding-up speeds. Moreover, since the yarn is loose, its path becomes inexact and capture by the nozzle becomes uncertain. The reliability of the device is thus questionable.

Thus, at the present time, no device exists which can effect automatic bobbin-changing on a bobbin-winder which operates at high speed.

SUMMARY OF THE INVENTION

The present invention relates to a yarn winding apparatus and to a device for automatically replacing full yarn supports by empty supports and automatically passing the fed yarn from a full support to an empty support, at the receiving stations of textile machines. The combination of these operations is generally denoted by the term "bobbin-changing." The passing of the yarn from a full support to an empty support can itself comprise various stages, namely interruption of the supply of yarn to the full support, removal (of the yarn) while the support is being changed, if the yarn is delivered continuously, and anchoring on the empty support.

According to the present invention it is proposed to provide high speed frontal bobbin winding apparatus comprising at least one winding-up station, at least one yarn support gripping spindle with a horizontal axis, a rotatable winding cylinder mounted for movement into and out of tangential engagement with a package forming on a yarn support on said spindle, a fixed yarn guide and a reciprocable yarn guide for distributing yarn along the yarn support in a triangular plane of movement, a loading/unloading unit including at least two parallel spindles, one for removing a wound yarn package from the gripping spindle and another for placing an empty yarn support on said gripping spindle, said paralled spindles being movable in turn into an aligned position in axial alignment with said gripping spindle, a nozzle for capturing and removing the yarn fed to the yarn support, said nozzle having a rectilinear capture slit communicating with a channel through which a stream of fluid may be fed at high speed, means for cutting yarn being associated with the nozzle and means for mounting the nozzle so that it is movable between a capture position, in which it is adjacent and aligned with said triangular plane of movement, to capture a yarn as it moves from the fixed guide to the reciprocating guide, and a second position adjacent said gripping spindle, to engage the yarn on an empty yarn support carried by said gripping spindle.

Such apparatus can operate on a winding machine operating at high speed and is capable of carrying out the operation with a minimum amount of waste.

It is also proposed to provide a device for use on an existing machine. Thus, according to the invention, there is further provided apparatus for automatic bobbin changing on a high speed frontal winder having, at the or each winding-up station, at least one yarn support gripping spindle with a horizontal axis, a rotatable winding cylinder mounted for movement into and out of tangential engagement with a package forming on a yarn support on said spindle, a fixed yarn guide and a reciprocable yarn guide for distributing yarn along the yarn support, said apparatus being preferably mounted on a frame;

a loading/unloading unit including at least two parallel spindles, one for removing a wound yarn package from the gripping spindle and another for placing an empty yarn support on said gripping spindle, said parallel spindle being movable in turn into an aligned position in axial alignment with a gripping spindle of the machine;

a nozzle for capturing and removing the yarn fed to the yarn support, said nozzle having a rectilinear capture slit communicating with a channel through which a stream of fluid may be fed at high speed and means for cutting the yarn associated with the nozzle;

means for mounting the nozzle so that it is movable between a capture position in which the slit extends in a plane including the reciprocating yarn between the fixed gude and reciprocable guide to capture a yarn as it moves from the fixed guide to the reciprocating guide and a second position adjacent said aligned position, to engage the captured yarn on an empty yarn support carried by said gripping spindle.

The nozzle is preferably supplied by a gaseous fluid, preferably compressed air. Drive means are provided for the means for mounting the nozzle, the loading/unloading unit and its spindles, as well as for the frame carrying these elements. These drive means, as well as the supply of fluid for the nozzle, and, where appropriate, the cutting means, are controlled from an automatic sequence.

Any known nozzle may be used as the capture and removal nozzle. The said nozzle preferably comprises an elongated nozzle body having a longitudinal yarn passage the cross-sectional area of which increases from the upstream towards the downstream end, and a longitudinal slit which extends along a generatrix of the yarn passage over the greater part of the length of the latter and provides communication between the said passage and the exterior, the nozzle also preferably comprising a nozzle head which includes at least two pipelines for supplying gaseous fluid, positioned in a direction substantially parallel to the axis of the yarn passage and opening into the latter, and a slit to enable the yarn to pass from the zone outside towards the yarn passage.

The cutting means associated with the nozzle are advantageously fixed to the body of the latter and are preferably positioned at the bottom of the slit. Since they must always fulfill their function perfectly, they consist advantageously of a blade, the cutting part of which can be renewed after each cutting operation.

The nozzle may be produced in accordance with customary dimensions, that is, preferably having a thickness of the order of 10 mm and a length of the order of 150 mm which makes it possible to draw a yarn of average gauge (150 to 200 dtex) travelling at speeds of 100 meters/second and more, whilst imparting to it a tension which can be as much as 25 grams and more, depending on the air flow rate. By selecting suitable dimensions for the nozzle and appropriate air flow rates, it is possible to draw yarns with greater tensions or to draw yarns of higher gauges such as carpet yarns (approximately 2,500 dtex). Such a nozzle can also grip a yarn to which a lateral (reciprocating) movement has been imparted, in addition to its longitudinal movement, it being possible for the speed of this lateral movement to be 10 to 15 meters/second. The capture position is situated at the edge of the triangular plane formed between the last fixed guide and the reciprocating distribution guide.

The means for mounting the nozzle may comprise a transfer carriage which can effect a vertical translational movement between two positions, of which one is situated at the capture point and the other makes it possible to anchor the yarn on the empty support. The carriage may have a capture head which pivots about an axle firmly fixed to the carriage and parallel to the axis of the winding cylinder, when the bobbin-changing device is considered in the working position. The capture nozzle is then mounted so as to pivot and slide on the capture head and the pivoting axle of the nozzle is situated in a plane perpendicular to the axis of the winding cylinder. The nozzle will then slide in a direction parallel to the axis of the winding cylinder. These two movements (pivoting and sliding) make it possible, in particular, to pass from a retracted position to the capture position. The nozzle is thus positioned in such a way that, during these movements, the slit is located adjacent the triangular plane mentioned above. In the capture position, the slit is substantially parallel to the path of the yarn at its direction-changing point. Advantageously, the capture position is situated at the said direction-changing point. The movements of the nozzle and of the yarn (reciprocating movement) make it possible for the latter easily to pass through the capture slit and thus to be taken up over the entire length of the slit by the high speed fluid stream and to be placed under tension. The capture of the yarn is further facilitated if the capture position is situated at the direction-changing point because the tension of the yarn falls during the change in direction. Thus, when the yarn is travelling at a speed which can be as high as 7,000 meters/minute, the capture procedure can be 100% reliable. The capture and removal nozzle is of course connected to a waste receptacle.

From the capture position as far as the anchoring position, the movements of the nozzle, the capture head and the transfer carriage depend on the geometry of the bobbin-winder. Likewise, the structure of the loading/unloading means depends on that of the bobbin-winder.

According to a preferred embodiment, the present bobbin-changing device is associated with a frontal bobbin-winder which possesses special characteristics to enable it to be suitable for bobbin-changing. These special characteristics are as follows:

the length of the spindle and that of the yarn support tube are such that the tube projects beyond the spindle by a length which can be of the order of 10 mm;

the reciprocating yarn guide is behind the winding cylinder (for example 10 to 20 mm); and the spindle is behind the reciprocating guide and consequently behind the winding cylinder (for example, 30 to 50 mm).

Moreover, advantageously, the system for gripping the yarn support on the spindle permits easy unlocking, and its control can be integrated into an automatic sequence characteristic of the bobbin-winder.

The starting-up of the automatic sequence for the operations carried out by the bobbin-winder (locking and unlocking of the yarn support, optionally formation of an attachment tail and the like) can be triggered manually or by means of the bobbin-changing device.

Obviously, at each winding-up station, the bobbin-winder can have several spindles (2, 3 or 4) distributed around the winding cylinder, in order to wind up several yarns simultaneously. In this case, there is a capture position for each yarn and an anchoring position for each support. On this type of bobbin-winder, anchoring is effected by penetration of the nozzle head (or nozzle nose) into the part of the support which projects beyond the spindle, thus bringing the yarn into contact with an anchoring member provided on the yarn support.

The loading/unloading means consist of at least one spindle for removing the coil and one spindle for placing an empty support in position (on loading spindle), the spindles being parallel and advantageously firmly fixed, and forming a movable assembly.

According to one embodiment, the spindle for removing the coil comprises a tube, the external diameter of which corresponds to the internal diameter of the yarn support, and which is equipped with at least one longitudinal slit extending along a generatrix over its entire length, and a slide-bar which is positioned inside the tube and which carries at least one claw which can expand radially through the slit to grip the full tube by its end which projects beyond the winding-up spindle, and, by sliding, to transfer the tube onto the removal spindle. The loading spindle comprises a tube, the internal diameter of which corresponds to the external diameter of the yarn support and in which it is possible to place an empty support, and a push-rod which slides inside the tube in order to push the empty support onto the winding-up spindle.

According to an advantageous embodiment, the removal spindle is equipped with a stop for the end of the tube, firmly fixed to the slide-bar and projecting through the slit, the said stop being able, as a result of shifting the slide-bar, to push the tube off the removal spindle. In this embodiment, the loading spindle can be identical to the removal spindle, the two spindles alternately fulfilling the loading and unloading functions.

The loading/unloading unit, as well as the transfer carriage, can be mounted on a frame which can move, between the waiting position and the bobbin-winder on which the bobbin-changing operation is to be effected, in a direction parallel to the front of the bobbin-winder; the combination of these elements forms the bobbin-changing device.

Considering the bobbin-changing device when in the working position, according to a first embodiment the loading/unloading unit is hinged about an axle parallel to the axis of the winding cylinder; it can also effect a translational movement on the frame, in a direction parallel to the axis of the winding cylinder. It can also effect a vertical translational movement in order to serve the various bobbins of the same winding-up station. According to another embodiment, the loading-/unloading unit effects horizontal and vertical translational movements in a plane perpendicular to the axis of the winding cylinder. It can also include two sets of removal spindles and loading spindles. The frame carrying the bobbin-changing components can travel vertically in order to serve superposed winding-up stations. Advantageously, the bobbin-changing device serves at least one row of bobbin-winders which are aligned and which optionally possess superposed winding-up stations. It can move on rails on the ground or on overhead rails. Means for locking the bobbin-changing device in the working position may be provided. These can be, for example, retractable fingers or bolts which are firmly fixed to the bobbin-changing device and which engage in seats provided on the frame of the bobbin-winder. The means which drive the various components of the bobbin-changing device advantageously consist of hydraulic or pneumatic jacks. The bobbin-changing device itself may be driven by an electric motor.

The automatic system for controlling the drive means may be effected by means of pneumatic and/or electric and/or electronic logic. The automatic sequence characteristic of the bobbin-changing device is coupled with the automatic sequence characteristic of the bobbin-winder. The transmission of orders, namely from bobbin-changing device to bobbin-winder and vice versa, can be effected by mechanical contacts or fluid or magnetic cells and the like. Advantageously, when automatic operation is effected by means of pneumatic logic, the orders are transmitted by means of the bolts for locking the bobbin-changing device and of the seating means for these on the bobbin-winder. For this purpose, lengths of pneumatic pipelines are provided, on the one hand, in the bolts firmly fixed to the bobbin-changing device, and, on the other hand, in the corresponding seats provided on the frame of the bobbin-winder. When the bolts move into place, the lengths are automatically joined together, enabling orders to be passed. Gaskets are provided where the lengths join.

Each sequence is checked before triggering the following sequence, in accordance with known rules for sequential automatic operations. The check can be effected, for example, by means of position sensors. However, the check of the sequences involving the yarn being taken up by the nozzle and the releasing of the yarn is advantageously effected by means of the pneumatic device for detecting the presence of varn. Such a device is advantageously mounted on the nozzle head.

In order that the invention will be better understood, the following description is given, merely by way of example, reference being made to the accompanying drawings. For simplicity, in the following description the device for effecting automatic bobbin-changing will be referred to as an "automaton."

DESCRIPTION OF THE PREFERRED EMBODIMENTS

It will be noted that in FIGS. 1, 3, 4, 5, 12, 13, 14 and 16, the movable elements such as the nozzle, the loading/unloading unit, the transfer carriage and the slide-bar of the removal and loading spindles have been represented in different positions.

Figure 1:
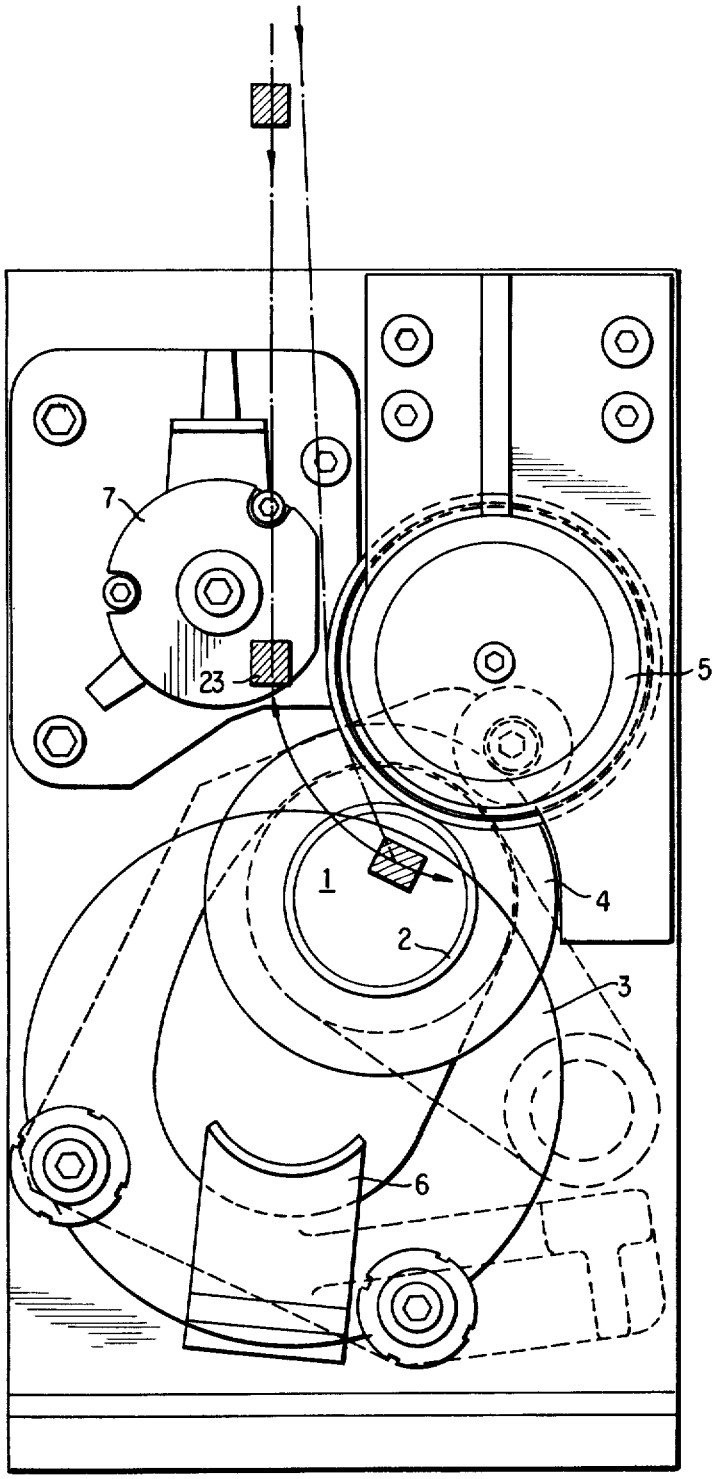
FIGS. 1 and 2 represent respectively a front and a side elevation of a bobbin-winder on which bobbin-changing is to be effected in accordance with this invention.
Figure 2:
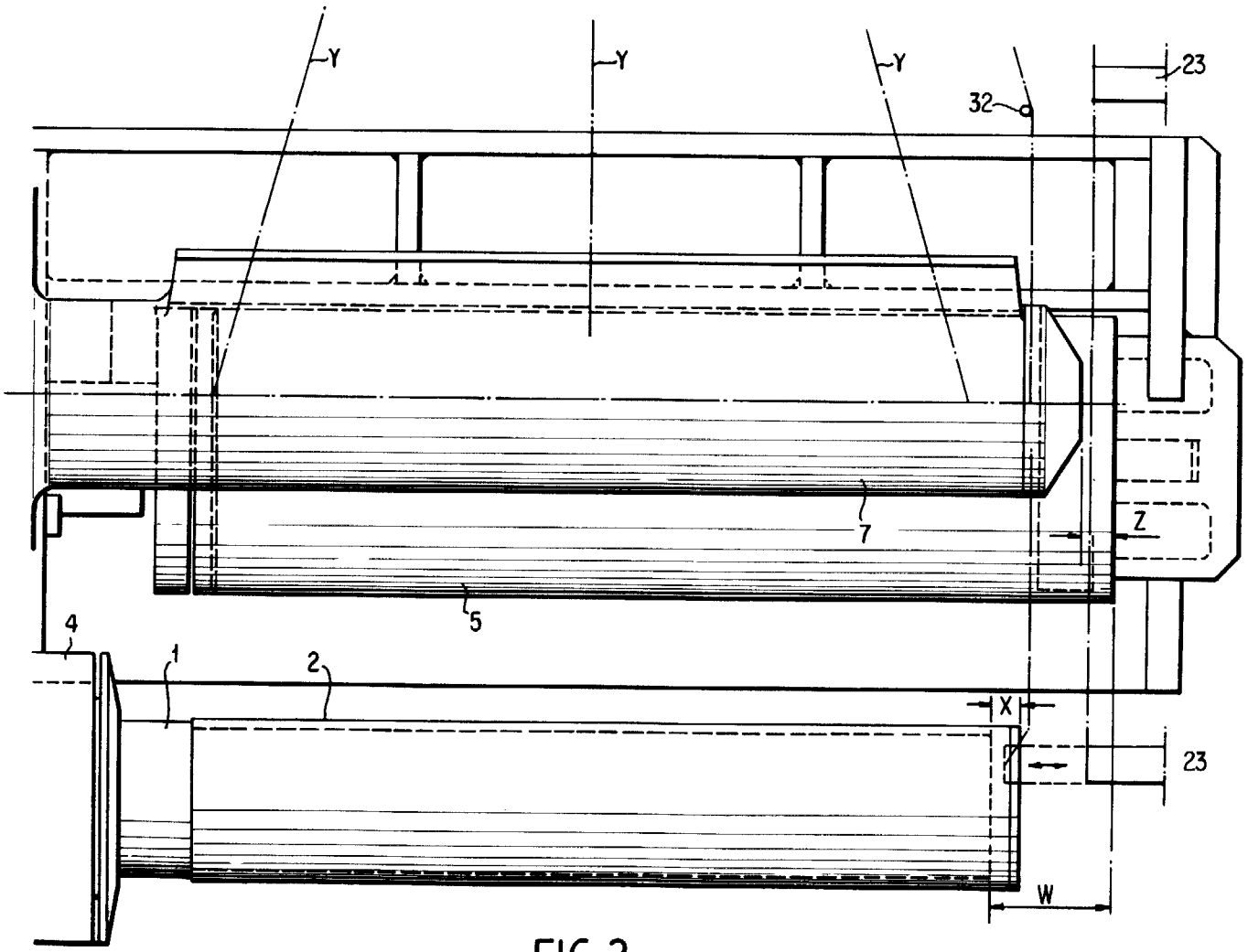

According to a first embodiment represented in FIGS. 1 to 6, and 28 the bobbin-winder on which the bobbin-changing operation is to be effected (shown in FIGS. 1 and 2) comprises a winding-up spindle 1 intended for mounting a tube 2 on which the coil 3 is to be formed. The system for gripping the tube on the spindle (not represented) consists of a gripping sleeve made of a resilient material, which can contract radially under the effect of vacuum to lock the coil support. The spindle is assisted by a turbine employing a gaseous fluid 4 and the peripheral speed of the coil is achieved by tangential contact between the latter and a winding cylinder 5, the axis of which is parallel to the axis of the spindle. As the size of the package increases, the spindle can move radially relative to the winding cylinder. At the end of the winding process, after contact between the package and the winding cylinder has been broken, the spindle can be braked by a brake 6. The bobbin-winder is completed by a device 7 for distributing the yarn with a reciprocating movement, it being possible for this device 7 to be a grooved cam equipped with a butterfly guide which takes up the yarn automatically. It can optionally comprise an automatic device for forming an attachment tail 32. As can be seen in FIG. 2, the tube 2 projects beyond the spindle 1 by a length X which is, for example, of the order of 10 mm; the drive cylinder 5 projects beyond the spindle 1 by a length W for example, of approximately 40 mm, and it also projects beyond the reciprocating device 7 by a length Z which can be of the order of 15 mm. The bobbin-winder on which the bobbin-changing operation is to be effected also comprises an automatic sequence which is characteristic of it and which is made up of the following cycles:

| | |
|---|---|
| return of the spindle to the braking position<br>unlocking of the support | on the stop signal |
| Reverse operations: | |
| locking of the support<br>start of rotation of the spindle and bringing the support into contact with the drive cylinder | on starting signal |

The automatic sequence of the bobbin-winder can be triggered either manually or by means of the bobbin-changing device.

Figure 3:
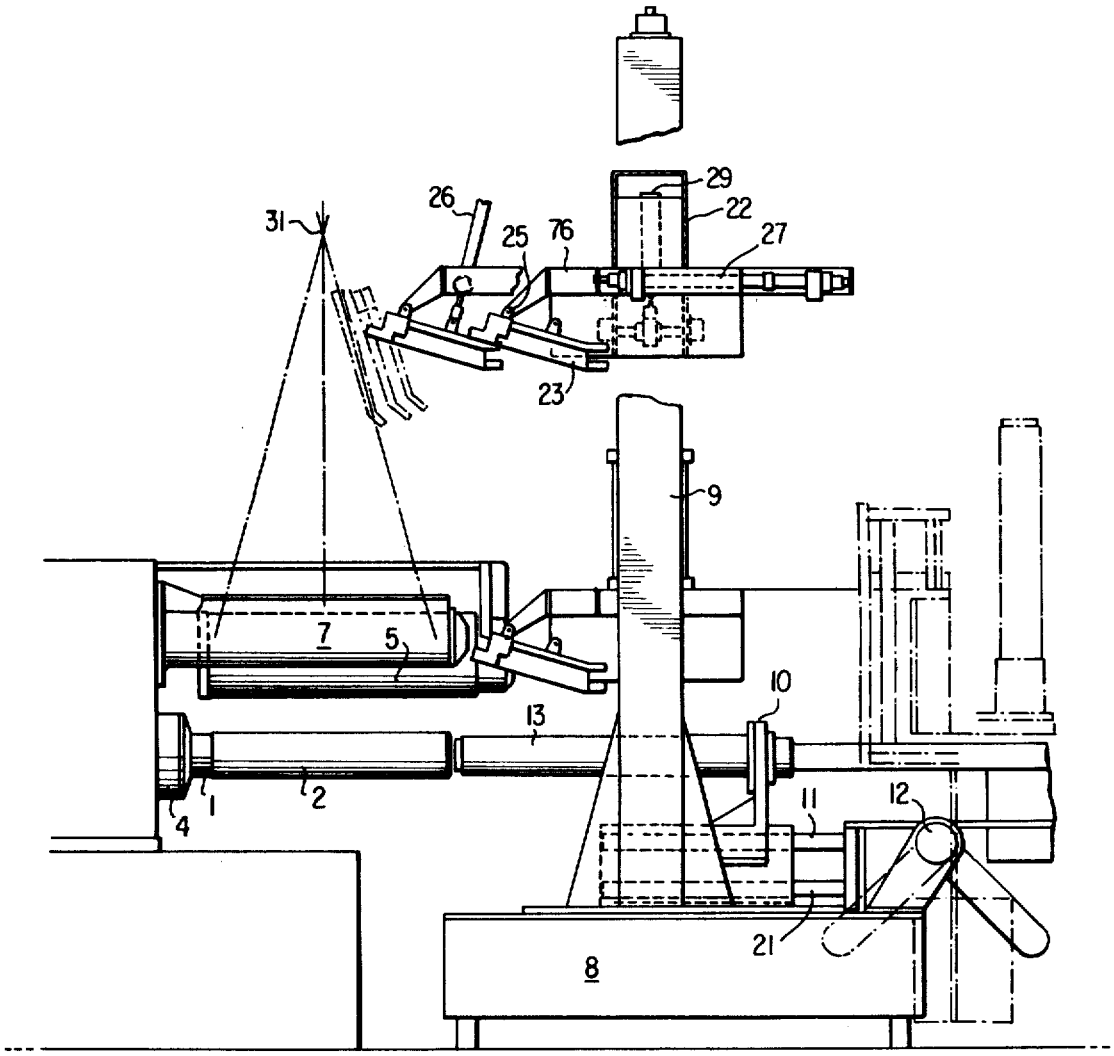
FIG. 3 is a front elevation of a first embodiment of the automaton according to the invention.
Figure 4:
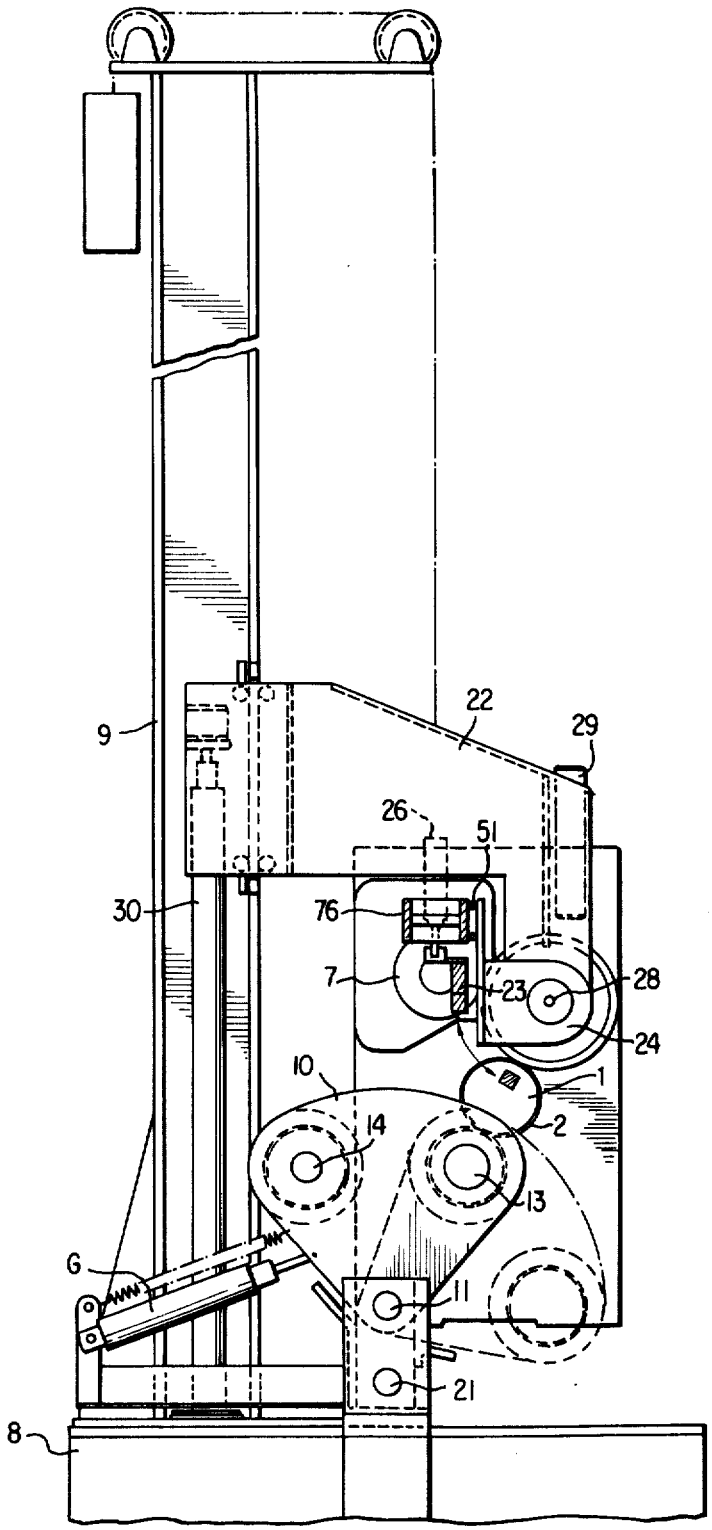
FIG. 4 is a rear elevation, facing the bobbin-winder, of the automaton according to FIG. 3.

One embodiment of automaton according to the invention is represented in FIGS. 3 and 4, and includes a bobbin-changing carriage 8 which can move on rails in the ground, and a vertical column 9 firmly fixed to the carriage. The carriage may be driven by an electric motor (not shown). The carriage and column form a frame which supports the other components of the automaton. On the carriage 8, there is mounted a loading/unloading unit 10 which can pivot about an axle 11 parallel to the axis of the spindle 1 (the automaton being considered when in the working position) between a position for removing the package and a position for placing the empty tube in place. The loading-/unloading unit 10 can rock backwards, about an axle 12 extending in a direction substantially perpendicular to the axle 11. The unit 10 can also effect a translational movement in a direction parallel to the axis of the spindle 1. In making this movement, it is guided by the axle 11 and an axle 21 parallel to the axle 11. The unit 10 carries two spindles, namely a spindle 13 for removing the coil and a loading spindle 14 (see FIG. 4) for placing the empty tube in position. When the automaton is in the working position, the two spindles are parallel to the spindle 1 of the bobbin-winder, one of them being positioned so as to be in a coaxial extension of the spindle of the bobbin-winder.

Figure 5B:
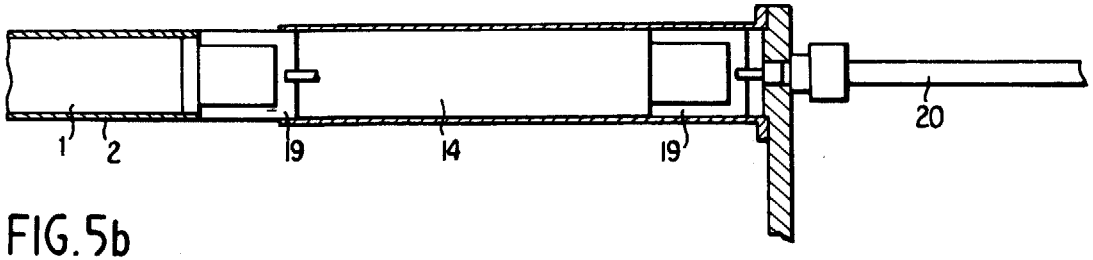
FIG. 5*b* is a side elevation in cross-section, showing, the details of the spindle for placing the empty support in position.
Figure 5A:
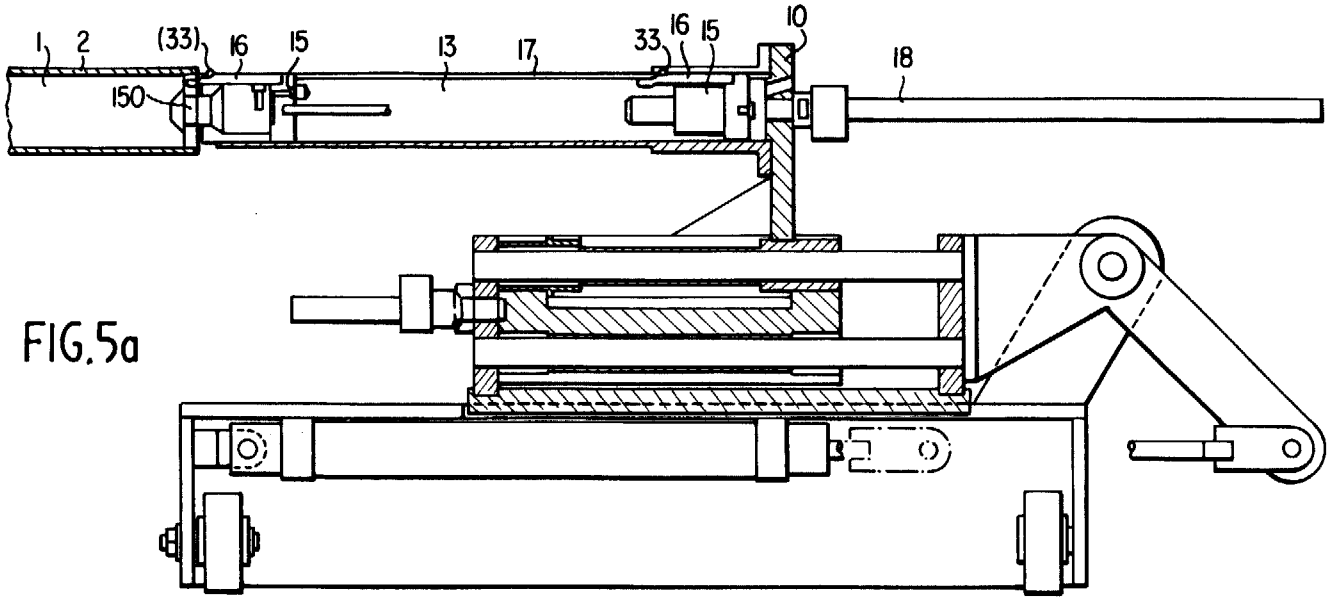
FIG. 5*a* is a side elevation in cross-section, showing the details of the spindle for removing the package.
Figure 6:
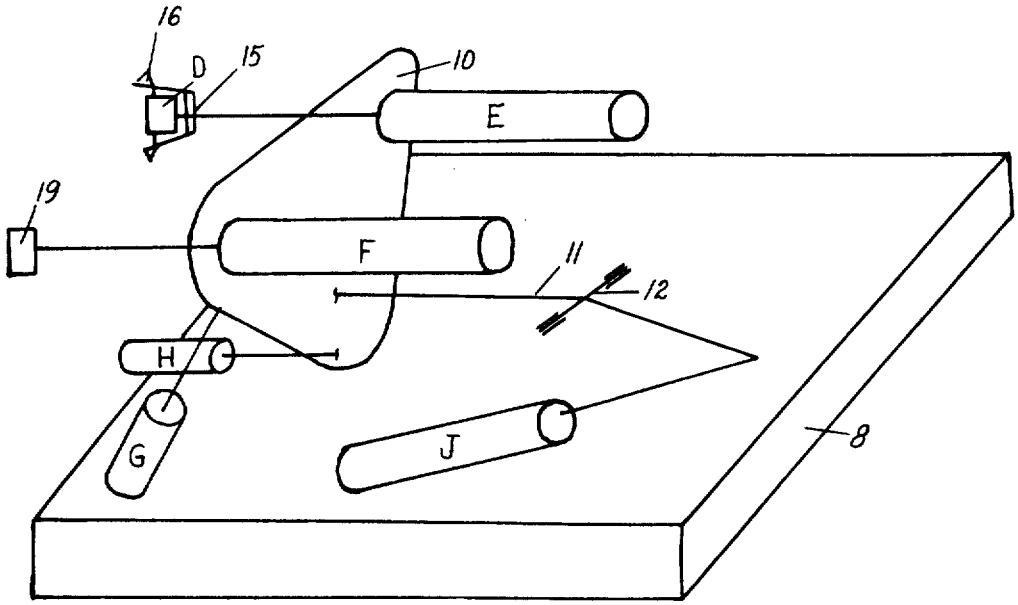
FIG. 6 is a diagrammatic view showing the means for actuating the components of the loading/unloading unit of the automaton according to FIGS. 3 to 5.

As can be seen in FIG. 5*a*, the removal spindle 13 has a tubular shape and has an external diameter corresponding to the internal diameter of the tube 2. A slide-bar 15 can travel inside the spindle 13 and has two claws 16 which can expand radially (only one being represented), and which can penetrate into the wall of the tube which is made of a relatively soft material (for example cardboard). If the tube were hard (re-usable support), a groove would be formed, inside which the claws would penetrate. The spindle 13 is provided with two longitudinal slits 17 extending along generatrices in order to allow the claws 16 to pass through when the slide-bar 15 moves, the slide-bar 15 being controlled by the rod 18 of a pneumatic jack E which cannot be seen in FIG. 5*a* but which has been represented in FIG. 6. The distance between the claws 16 is also controlled by a jack D mounted on the slide-bar 15 (FIG. 6). The nose 150 of the slide-bar 15 forms a conical centring device intended to penetrate into a seat provided for this purpose in the winding-up spindle 1, in order to position the spindle 13 in alignment with the spindle 1. Moreover, the nose 150 of the slide-bar 15 is equipped with a brake lining. It thus forms a temporary safety brake for the spindle 1, obviating the danger that the claws might penetrate into a rotating support, which would cause the end of the latter to be destroyed. The claws 16 can optionally be equipped with a stop 33 which projects permanently through the slits 17, and against which the end of the coil tube 2 presses. When the tube 2 is on the spindle 13, and when the slide-bar 15 is shifted in the direction of the free end of the said spindle, the stop 33 will push the tube 2 carrying the completed package 3 until it is ejected from the spindle 13. It will be possible to employ this procedure at the station where packages are received.

The loading spindle 14 is shown in FIG. 5*b*. It is tubular and is intended to receive an empty tube; because of this, its internal diameter is slightly greater than the external diameter of the tube 2. It can be provided with resilient elements (not shown) such as coiled springs for holding and centring the empty tube. A push-rod 19 slides inside the spindle 14 and is controlled by the rod 20 of a pneumatic jack F which cannot be seen in FIG. 5*b* but which has been shown in FIG. 6. The movements of the components of the loading/unloading unit 10 are also controlled by jacks. The series of jacks connected to the unit 10 is illustrated diagrammatically in FIG. 6:

D controls the movement of the claws 16, E the slide-bar 15, F the push-rod 19, G the pivoting of 10 about the axle 11, H the translational movement of 10, and J the rocking of 10 about the axle 12.

The vertical column 9 is machined to form a sliding-post and acts as a guide for a transfer carriage 22 which carries a capture nozzle 23 via a capture head 24. The movement of the carriage 22 is controlled by a jack 30.

Figure 7:
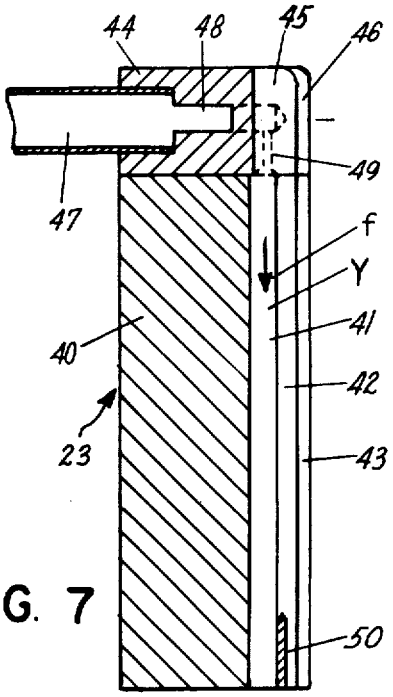
FIG. 7 is a view in longitudinal cross-section of one type of capture nozzle used.
Figure 8:
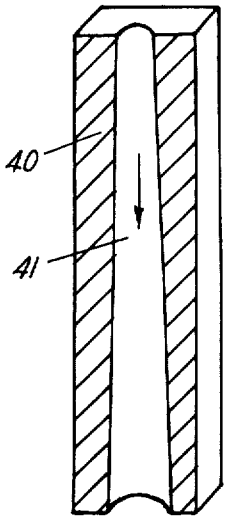
FIG. 8 is a fragmentary cross-section of the capture nozzle of FIG. 7.
Figure 11:
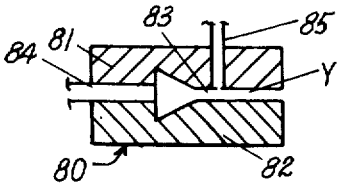
FIG. 11 is a cross-section taken along the line a—a of FIG. 9.
Figure 12:
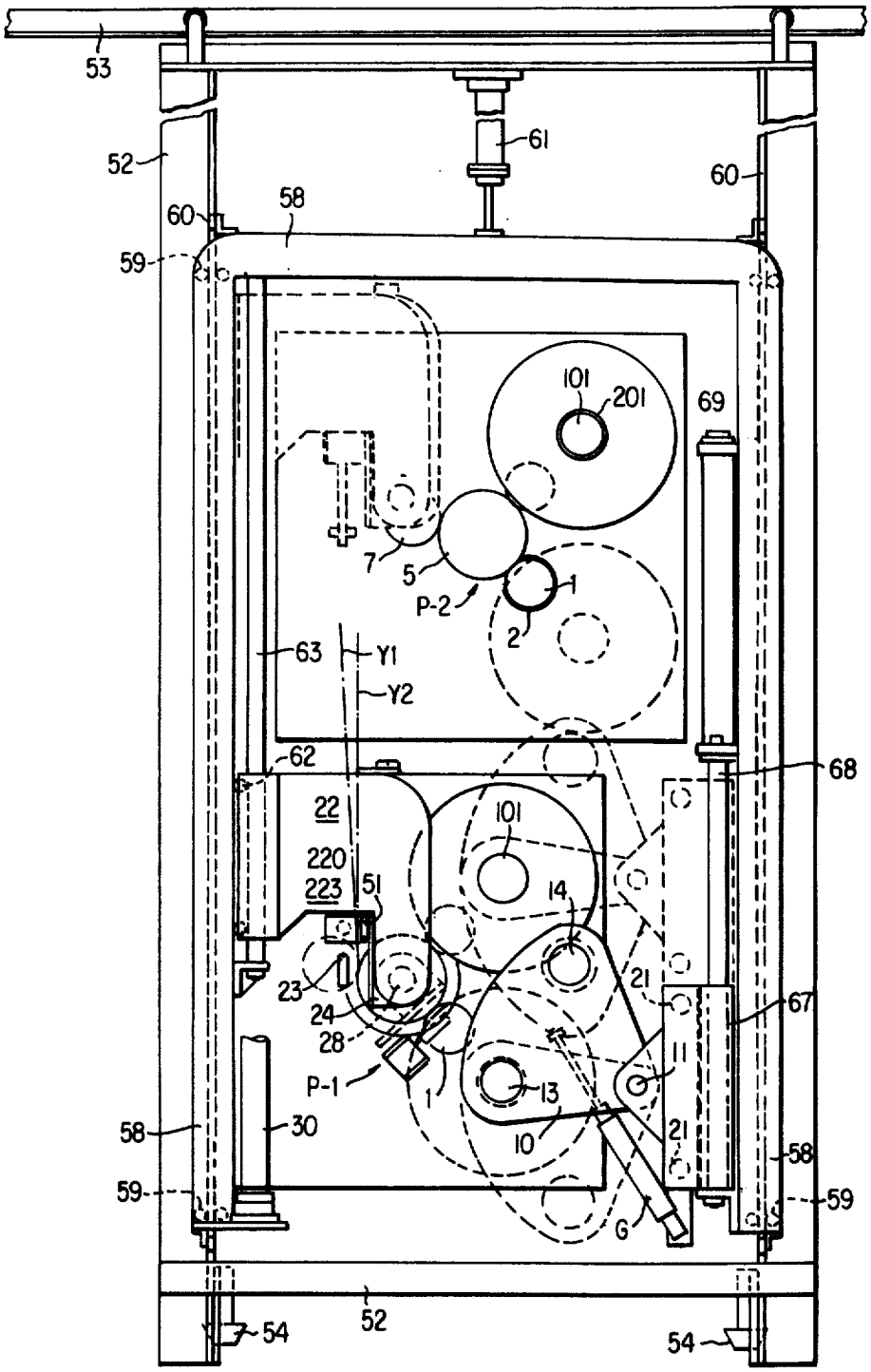
FIG. 12 is a rear elevation of a second embodiment of the automaton.
Figure 13:
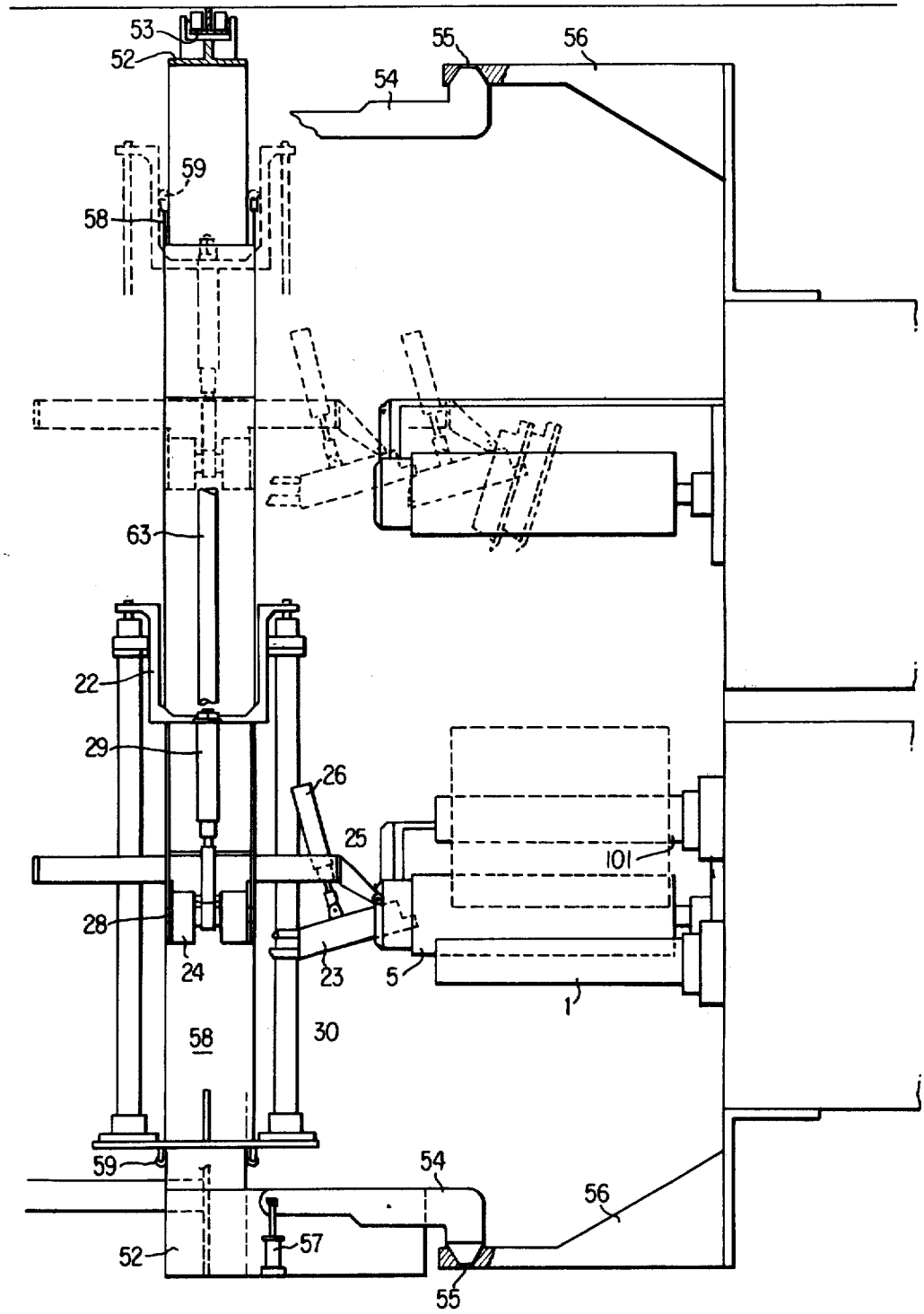
FIG. 13 is a partial side elevation of the automaton of FIG. 12.
Figure 14:
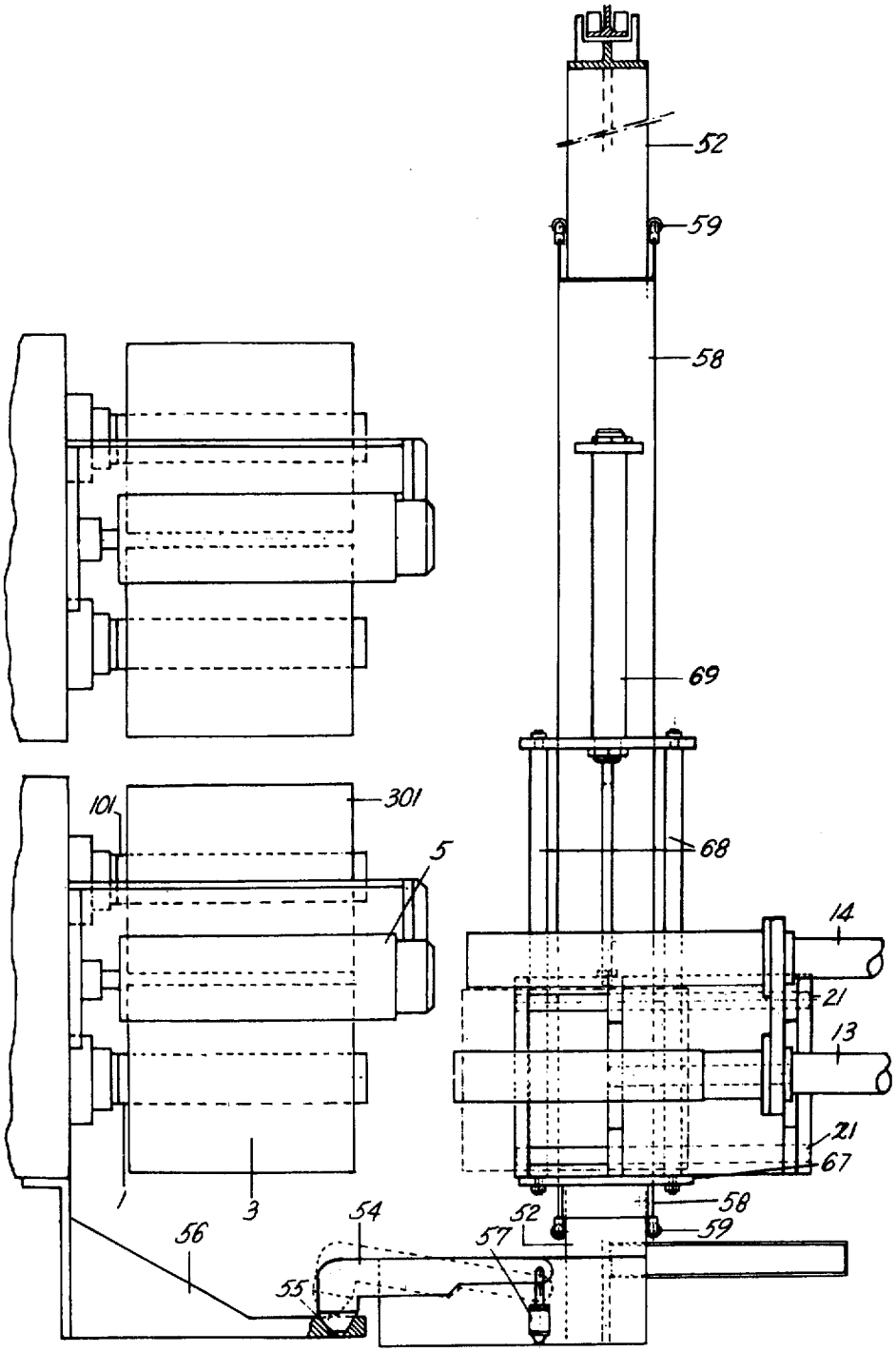
FIG. 14 is another partial side elevation of the automaton of FIG. 12.
Figure 15:
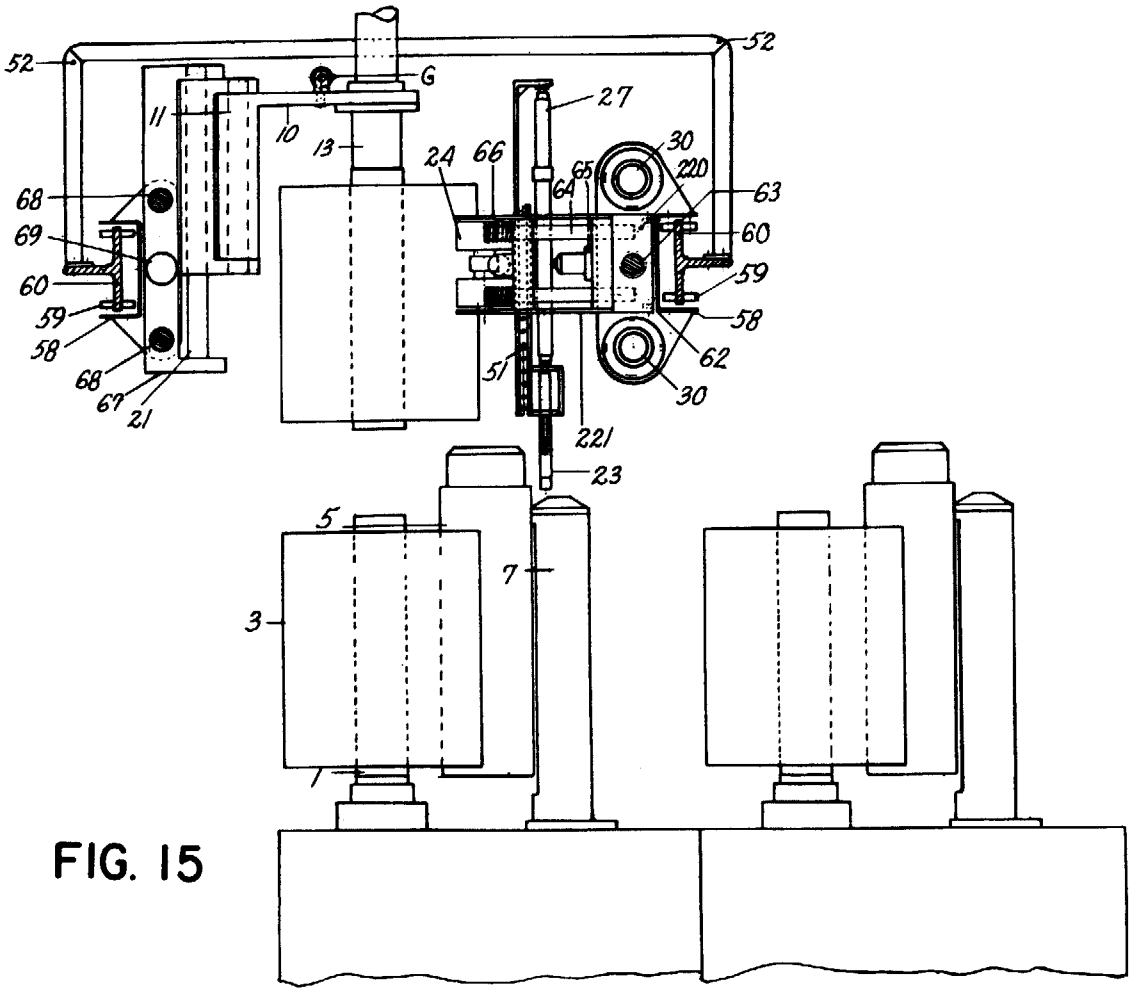
FIG. 15 is a plan view in cross-section of the automaton of FIG. 12.

As already indicated, the capture nozzle, which is also a removal and transfer nozzle. may be together with its attached components, in FIGS. 7 and 11. The nozzle comprises a nozzle body 40 having a longitudinal channel 41 to allow the fluid (advantageously compressed air) and the yarn to pass, in the direction of the arrow *f*. The channel 41 is connected to a waste receptacle (not shown). As can be seen in FIG. 8, the cross-section of the channel 41 increases in size from the upstream towards the downstream end, in the plane perpendicular to the plane of FIG. 7. The channel 41 is equipped with a longitudinal capture slit which extends over its entire length along a generatrix. One of the lips 42 of the slit can be seen, the edge 43 of which is widened out to make it easier to introduce the yarn.

Figure 9:
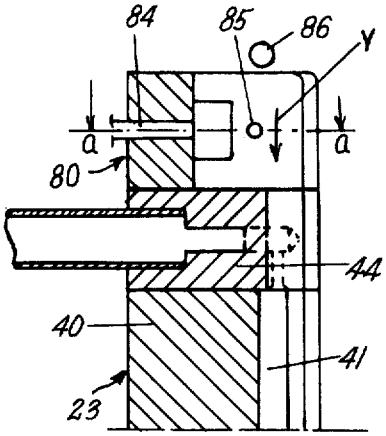
FIg. 9 is a fragmentary longitudinal cross-section of the capture nozzle with the device for detecting the presence of yarn.
Figure 10:
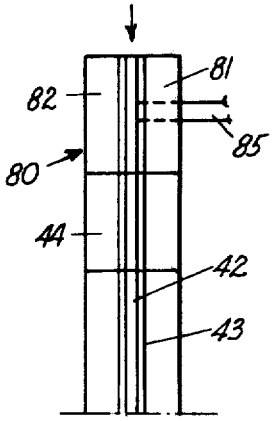
FIG. 10 ia a side elevation of nozzle and device of FIG. 9.
Figure 21:
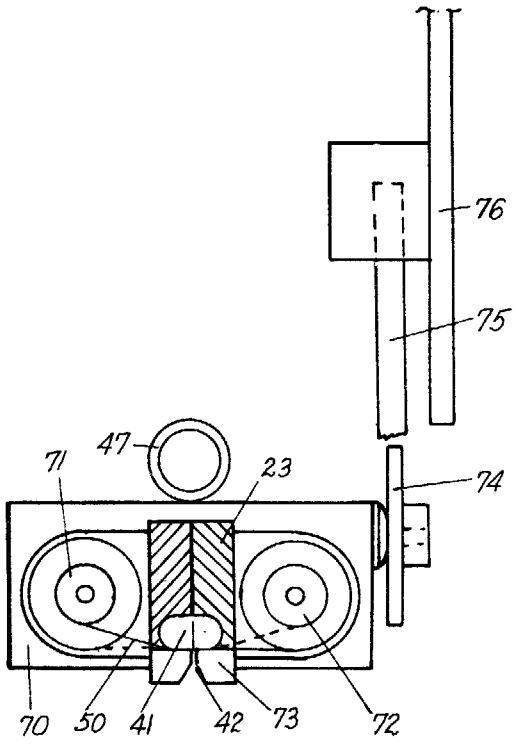
FIG. 21 is a side elevation in cross-section along the line *b*—*b* of FIG. 20 of the cutting components associated with the nozzle.
Figure 20:
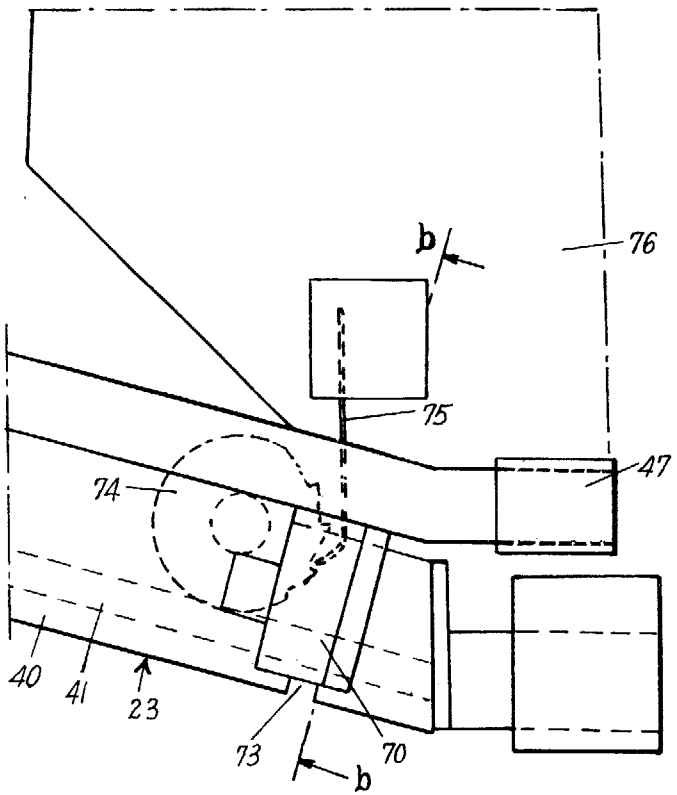
FIG. 20 is a partial front elevation representing the cutting components associated with the nozzle.

The nozzle 23 also includes a nozzle head 44, slit from top to bottom at 45, to allow the yarn to pass, the edge of the slit 45 being widened out at 46. The head 44 has an air supply pipeline 47 communicating with a U-shaped chamber 48, a part of which, situated on either side of the slit 45, is represented by a broken line. The head 44 is formed with two or more holes 49 which provide communication between the chamber 48 and the channel 41, for the supply of compressed air. As can be seen in FIGS. 9, 10 and 11, the nozzle head is surmounted by a pneumatic device 80 for detecting the presence of yarn. Overall, it consists of two plates 81 and 82 delimiting between them a space 83 in the form of a thin strip, situated in the extension of the slit 45, of thickness slightly greater than the diameter of the yarn, and through which the yarn passes, being guided by a guide 86 firmly fixed to the detector 80. A conduit 84 introduces a fluid, advantageously compressed air, into the space 83. A pressure monitor 85 opens into the space 83, between the path of the yarn and the air supply pipeline 84. When the yarn is present, a pressure reading is recorded on the monitor 85; in the absence of yarn, no pressure is noted. These readings give a reliable indication as to the presence of absence of the yarn, making it possible to be certain that the sequences involving the yarn being taken up by the nozzle and being released are carried out. A continuous cutting tape 50 is fixed at the downstream end of the nozzle body 40, and adjacent to the slit 42. The cutting part of the tape 50 can be renewed automatically after each cutting operation, by means represented in FIGS. 20 and 21.

A casing 70 carrying two spools 71 and 72 with parallel axes is positioned at the base of the nozzle 23; the spool 71, on which the tape 50 is coiled, is an unwinding spool; the spool 72 is a winding-up spool on which the spent tape is coiled. A notch 73, formed in the body 40 of the nozzle 23, makes it possible to position the tape 50, substantially at the intersection of the slit 42 and the channel 41. The spool 72 is driven by a ratchet wheel 74 connected to the spool 72 via a hollow worm and pinion combination (not shown). The pivoting movement of the nozzle is used to control the ratchet wheel, via a pawl 75 firmly fixed to a part 76 carrying the nozzle. Every time the nozzle pivots, the ratchet wheel 74 presses on the pawl 75 which causes the ratchet wheel to rotate, one step at a time, and hence causes the spool 72 to rotate and the tape 50 to move forwards.

By means of this system, the cutting operation is always carried out by a new part of the tape to give a 100% reliability.

The nozzle 23 is mounted so as to pivot and slide on the capture head 24. It pivots on the mounting part 76 about an axle (FIG. 3) situated in a direction perpendicular to the axis of the winding cylinder 5. It can slide with the part 76 in a direction parallel to this axis, by means of a ball sliding-post 51 (FIG. 4). The pivoting and sliding movements are controlled by jacks 26 and 27 respectively. The capture head 24 is mounted so as to pivot on the transfer carriage 22; the pivoting takes place about an axle 28 parallel to the axis of the spindle 1 (the automaton being considered when in the working position). This pivoting movement is controlled by a jack 29, the rod of which is firmly fixed to a rack and pinion device (not represented) acting on a cogwheel firmly fixed to the capture head. The weight of the carriage 22 and of the components which it carries is balanced by a counterweight.

The set of jacks and the starting up of the motor for driving the automaton are controlled by an automatic sequence characteristic of the automaton, by means of pneumatic and/or electric systems. The automatic sequences of the bobbin-winder and of the automaton are connected by order transmitters, (which may be pneumatic, electrical or mechanical.

The way in which the automaton operates is described below:

First of all it should be noted that, in general, terms, bobbin-changing on a bobbin-winder like that represented in FIGS. 1 and 2 involves the following operations, whether bobbin-changing is carried out manually or automatically:

1. interruption of the supply of yarn to the package (the yarn being delivered continuously);
2. drawing in the yarn and removal towards a waste station for the entire duration of the bobbin-changing operation;
3. stopping the rotation of the coil (breaking contact with the drive cylinder and braking of the spindle);
4. unlocking the yarn support from the spindle;
5. removal of the package;
6. placing an empty support in position on the spindle;
7. locking the empty support on the spindle;
8. starting up the movement of the spindle (for example by means of the turbine);
9. bringing the yarn support into contact with the drive cylinder and stabilising the speed;
10. anchoring the yarn on the support; and
11. optionally, forming an attachment tail.

The automaton carries out all these operations. The bobbin-winder on which the bobbin-changing operation is to be effected, gives a signal to the automaton which takes up a position opposite the position on which the bobbin-changing operation is to be effected; the automaton is immobilised in the working position by means of locks which are not represented in FIGS. 3 and 4; the automatic sequence then triggers the operations necessary for effecting bobbin-changing.

1. and 2. THE YARN BEING TAKEN UP BY THE NOZZLE 23 AND BEING CONVEYED TO THE WASTE RECEPTACLE The nozzle takes up the yarn in its triangular path of movement, that is to say between the fixed guide 31 and the reciprocating guide, over a portion which is travelling laterally. The jack 26 makes it possible to position the nozzle 23 so that its longitudinal slit is substantially parallel to the travel of the yarn at the end of its triangular path; the jack 27 makes it possible to move the nozzle forwards towards the yarn, the capture slit being in the plane of movement of the latter.

Figure 26:
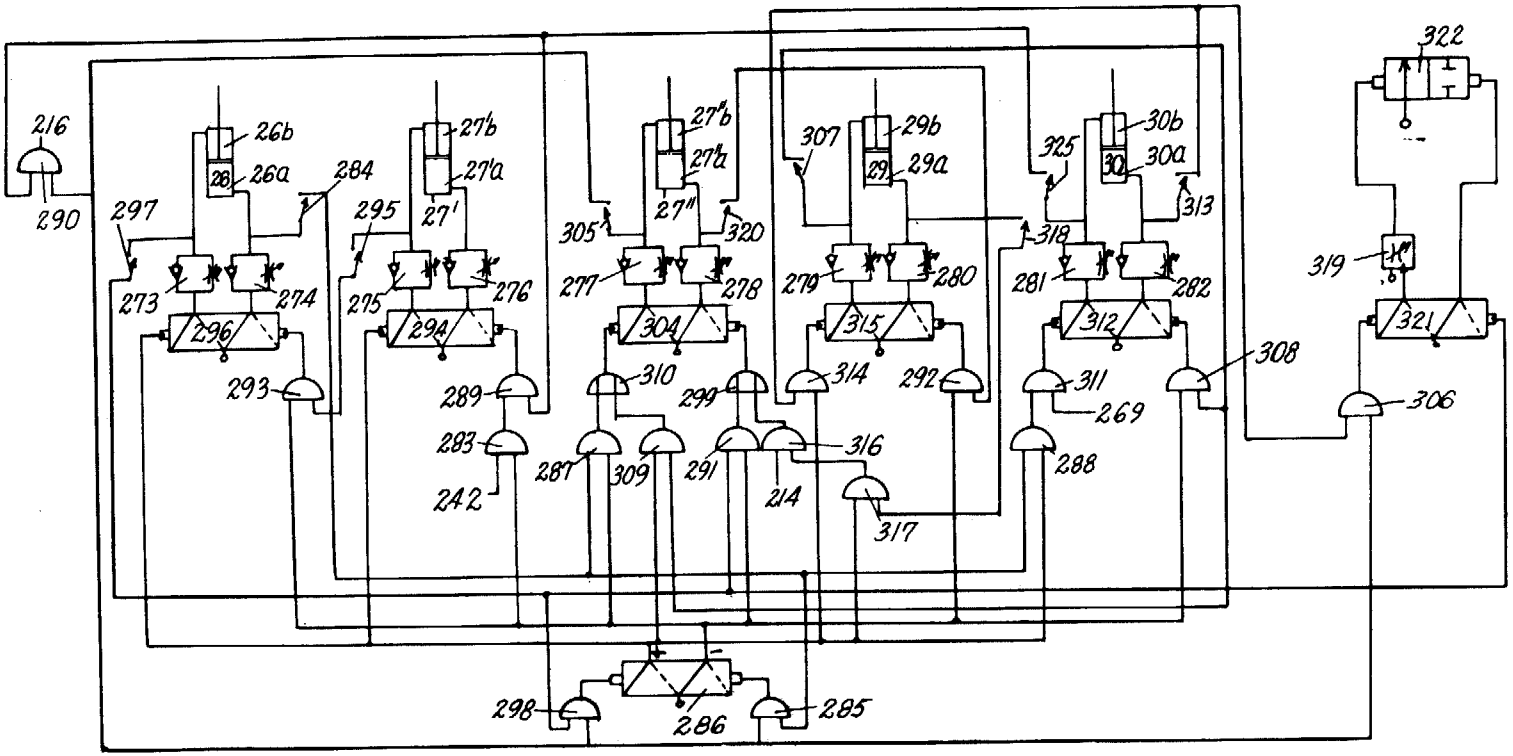
FIG. 26 is a complementary partial circuit diagram of the diagram according to FIG. 24 of the means for effecting the automatic sequence according to FIGS. 3 and 4.
Figure 28:
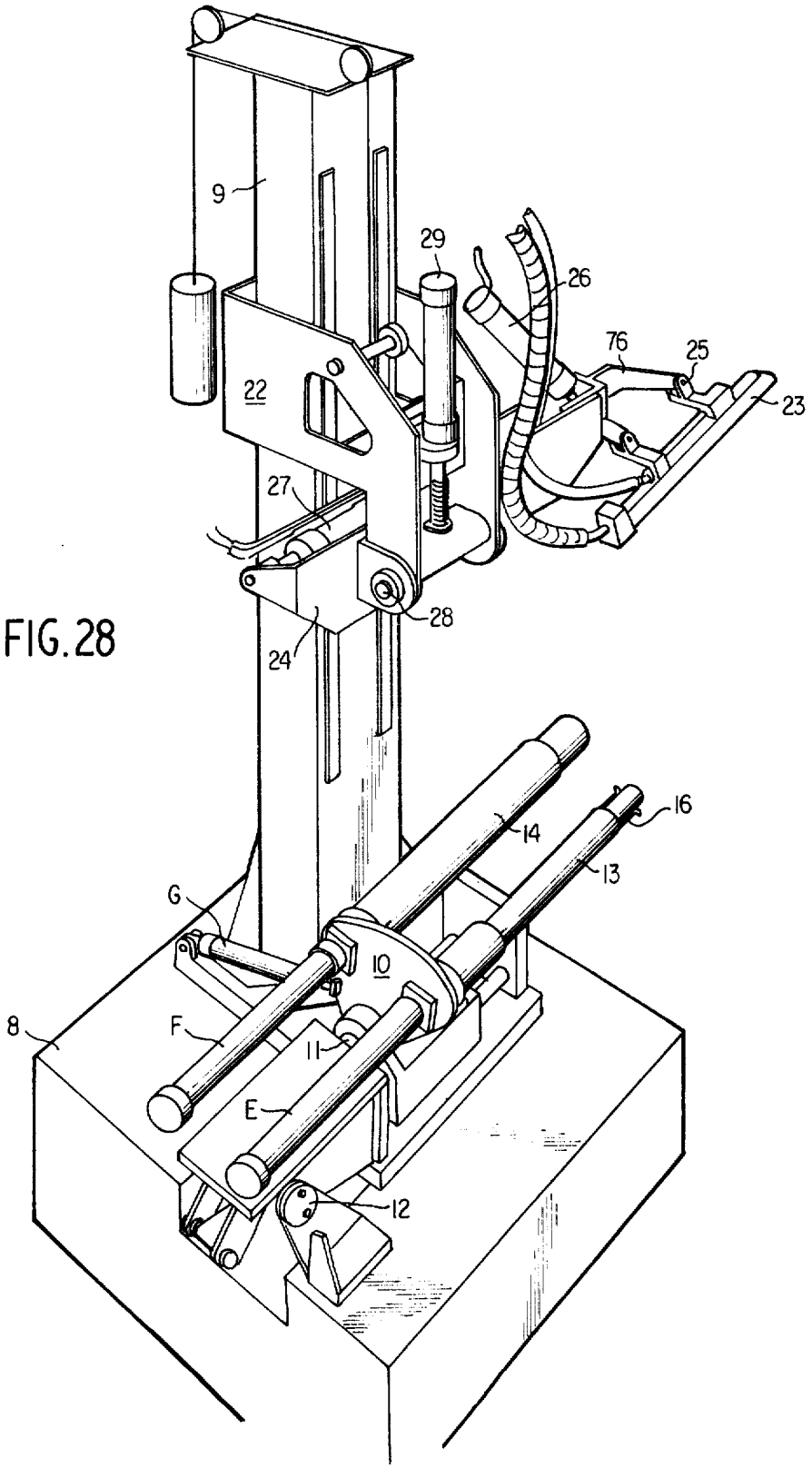
FIG. 28 is a perspective view of a bobbin-winder according to the present invention.

The nozzle passes from the retracted position to the capture position in three stages, as can be seen in FIG. 3. In a first stage, employing the jack 27, the nozzle is moved forwards in the horizontal position until it is a short distance from the zone over which the yarn travels as it makes its reciprocating movement: this is the "large forward movement" of the nozzle. In a second stage, the nozzle is pivoted by means of the jack 26 in order to bring the capture slit into the capture position, that is to say substantially parallel to the travel of the yarn at the end of the reciprocating triangular path. In a third stage, employing the jack 27, the nozzle is moved forwards until it is in the zone over which the yarn travels, in order to effect the capture operation: this is the "small forward movement" of the nozzle. The large forward movement can be carried out at high speed in order to gain time, whilst a slow speed can be chosen for the small forward movement, in order to prevent any sudden contact between the nozzle and the yarn which would risk damaging the yarn. The jack 27 is a double-action jack with four positions, comprising two chambers 27' and 27'' (FIG. 26).

Figure 19:
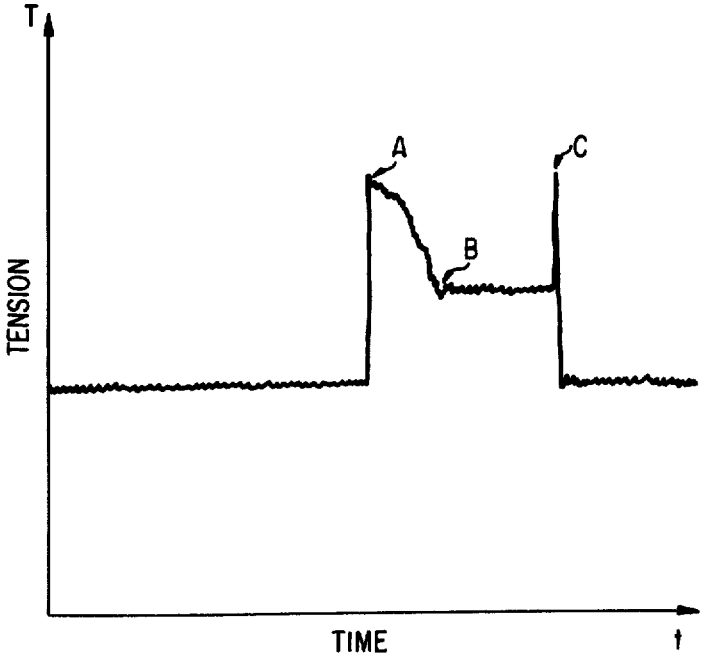
FIG. 19 is a graph representing the variations in the tension of the yarn during the capture sequence.

The operation involving catching the (moving) yarn and drawing it through the capture slit 42 is very reliable. This reliability is due to the fact that no fall in tension is recorded at the instant when the yarn is caught, as can be seen in FIG. 19. Any fall in tension is to be avoided because it would make it easier for the yarn to rub on the upstream components (for example feed rollers); if rubbing occurs, it becomes impossible to grip the yarn. On the diagram of FIG. 19 representing the tension T of the yarn as a function of the time $t$ during the capture sequence, an increase and not a fall in the tension is recorded at the instant when the yarn is taken up by the nozzle (point A); thereafter, a slight drop (point B) is recorded, corresponding to inclining the nozzle, followed by a plateau situated at a level higher than the level of the initial tension. The peak recorded at point C corresponds to anchoring (the yarn) on the support; thereafter, the tension stabilises at its initial level. Advantageously, the yarn is taken up at the end of its travel, at the instant where the tension of the yarn falls because of the change in direction. Thus, for an average winding-up tension of 20 grams, peaks at 40 grams and a minimum tension of 5 grams at the direction-changing points are recorded. This procedure leads to even greater reliability. After the yarn has been gripped, it is broken on the cutting tape 50 and conveyed to the waste receptacle. The nozzle 23 moves back and pivots substantially to the horizontal position, the nose of the nozzle being then in the vertical position relative to the zone Z of the drive cylinder, projecting beyond the reciprocating device.

3. and 4. STOPPING THE SPINDLE AND UNBOLTING THE TUBE

The automaton transmits to the bobbin-winder the order to trigger its automatic sequence; the latter controls the return of the spindle 1 to the braking position and the unlocking of the support 2.

5. REMOVAL OF THE PACKAGE

Whilst the yarn was being taken up by the nozzle 23, the removal spindle 13 took up a position in the extension of the spindle 1 in the "braking" position, in accordance with the automatic sequence. The spindle 1 being stopped and the yarn support unlocked, the automatic operation of the bobbin-winder transmits the information that a sequence has ended to the automaton, which starts up the remainder of the cycle. The jack E of the spindle 13 introduces the two claws 16 into the free zone X at the end of the yarn support 2. The jack D triggers the opening of the claws which expand and penetrate into the wall of the yarn support. The jack E begins its backward movement in accordance with the automatic sequence and the coil is transferred from the spindle 1 to the spindle 13.

6. PLACING OF AN EMPTY SUPPORT IN POSITION ON THE SPINDLE

The bobbin-changing combination 10 rocks about the axle 11 under the effect of the jack G; the loading spindle 14, carrying an empty tube, positions itself in the extension of the spindle 1. The jack F, acting on the push-rod 19, introduces the empty tube onto the spindle 1 and then returns to its starting position. The bobbin-changing combination, controlled by the jack H, moves back, and then, controlled by the jack J, rocks backwards about the axle 12. The purpose of this movement is to free the area in front of the bobbin-winder for the remainder of the sequence and to place the full bobbin in the vertical position, since this will make it easier subsequently to rip the bobbin and convey it to a removal station by any known means.

7. BOLTING OF THE YARN SUPPORT

The automatic sequence of the automaton transmits to the automatic sequence of the bobbin-winder the order to start up which involves the operations of bolting the support (by connecting the gripping cuff to the atmosphere), starting up the assistance turbine and moving the spindle forwards as far as an arresting stop situated near the winding cylinder, leaving a small space (approximately 2 mm) between thw winding cylinder and the yarn support (still empty). The starting up of the turbine 4 takes place gradually in two stages, by supplying air at a high pressure (6 bars) and then air at a low pressure 2 to 3 bars).

8. STARTING UP THE MOVEMENT OF THE SPINDLE (20 to 30 seconds) followed by retracting the arresting stop and bringing the yarn support into contact, without any sudden impact, with the winding cylinder.

9. SPEED STABILISATION (1 to 2 seconds), imparting a slight excess speed (a few parts per thousand to a few per cent) to the yarn support relative to the winding cylinder, in order that the yarn winds up preferably on the support and not on the cylinder. This excess speed can be achieved simply by providing the winding cylinder with bearing surfaces or starting rings of slightly greater diameter, situated at points corresponding to the ends of the support. After the speed has been stabilized, the automatic sequence of the bobbin-winder transmits to the automaton the information that a sequence has ended.

10. ANCHORING THE YARN

During the starting up of the movement, the transfer carriage 22 has descended along the column 9 and the nozzle 23 (still sucking up the yarn) passes in front of the end of the reciprocating device and raches the height of the winding cylinder 5. The head 24 begins a rotational movement about the axle 28 and the nozzle 23 stops in front of the spindle 1. The nozzle moves forward and passes inside the yarn support 2. The yarn rubs on the edge of the support, which is provided with an anchoring slit which catches the yarn and cuts it. The package begins to form. In accordance with the automatic sequence, the nozzle returns to the rest position (backward movement of the nozzle and rising of the transfer carriage 22 again).

11. FORMATION OF AN ATTACHMENT TAIL

When the bobbin-winder is provided with a device for forming an attachment reserve and when it is desired to make such a reserve, at the same time as the yarn is anchored, or after a slight delay (less than 1 second), the automaton gives the bobbin-winder the order to trigger the reserve. Preferably, the reserve comprises a first winding which is a waste winding and a second winding with non-touching turns which forms the actual reserve. The yarn is then released by the device for forming the attachment tail and falls into the reciprocating guide which automatically takes up the yarn.

After the bobbin-changing operation, the automaton returns to the waiting position on a fixed station which provides for the full bobbin to be lifted off and removed to a sorting/packaging station, as well as for empty bobbins to be supplied.

If the removal spindle 13 is equipped with claws with a stop 33, the removal of the package is advantageously carried out by means of the slide-bar 15 and the stops 33. By causing the slide-bar to effect a translational movement towards the free end of the spindle 13, the stops 33 push the tube 2 carrying the package, which is thus ejected from the spindle, placed preferably in the horizontal position, and can be collected on any suitable means.

The first starting up procedure, when the operation begins, is carried out manually, since the automaton works only on a machine operating under normal running conditions.

Figure 17:
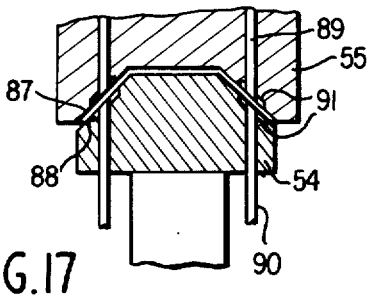
FIGS. 17 and 18 are detailed front (in cross-section) and plan views of the locking bolts of the automaton.
Figure 18:
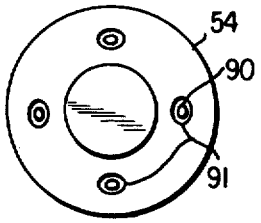

A second embodiment of automaton according to the invention is shown in FIGS. 12 to 15. It is provided for effecting bobbin-changing on a bobbin-winder of the type described in the first embodiment, but which has two supports for winding two yarns simultaneously, at each winding-up station. Each winding-up station of the bobbin-winder thus comprises a winding cylinder 5, two spindles 1 and 101, the axes of which are situated in the same vertical plane, for mounting the yarn support tubes 2 and 201 and a reciprocating distribution device 7, with a single yarn guide, common to both spindles. As can be seen in the Figures, the winding-up stations are located on two different levels. The frame of the automaton consists of a metal framework 52 which can travel on overhead rails 53 via means which are not represented, such as an electric motor driving a friction roller. The carriage 52 carries retractable fingers (or bolts) 54 which can lock into corresponding seats 55 provided in the frame 56 of the bobbin-winder on which the bobbin-changing operation is to be effected. These fingers make it possible to position and immobilise the automaton in the bobbin-changing position. The fingers are controlled by means of jacks 57. When the automatic operation is effected by pneumatic control, an order can be transmitted advantageously from the bobbin-winder to the automaton via pipelines connected at the level of the locking fingers 54, as can be seen in FIGS. 17 and 18. Lengths of pipelines 89 and 90 through which the pneumatic fluid can flow pass through the fingers 54 and their seats 55. When the fingers 54 take up their position, the conical surfaces 87 and 88 become juxtaposed, thus placing the length 90 in the extension of the length 89. Gaskets 91 are provided where the two lengths join.

Inside the framework 52, there is positioned a second framework 58 (FIGS. 12 to 14) of lesser height but of the same width, it being possible for this second framework to slide vertically in the framework 52 by means of rollers 59 resting on sliding-posts 60 firmly fixed to the framework 52. This movement is controlled by a jack 61 and makes it possible to serve two superposed winding-up stations such as P 1 and P 2. The framework 58 supports the transfer carriage 22 (which carries the capture nozzle 23, via the capture head 24) and the loading/unloading unit 10 carrying the removal spindle 13 and the positioning spindle 14. The transfer carriage 22 can effect a translational movement along a vertical side of the framework 58 in order to enable the nozzle to pass from the capture level to the anchoring level. When making this translational movement, it is guided by rollers 62 resting on the framework 58 and by a cylindrical column 33. The movement is controlled by two jacks 30. The transfer carriage 22 is divided into two parts 220 and 221.

The part 220 is carried by the framework 58 by means of the column 63 and the rollers 62. The part 221, which carries the capture head 24 and the nozzle 23, is mounted on the part 220. Mounting is effected by means of horizontal guide sliding-posts 64 (FIG. 15), which are situated in planes perpendicular to the axis of the winding cylinder 5 and which are firmly fixed to the part 220. These sliding-posts make it possible to shift the part 221 relative to the part 220 in order to shift the nozzle 23 from a first capture position for a first yarn Y 1, to a second capture position for a second yarn Y 2. The shifting movement of the part 221 relative to the part 220 is controlled by a jack 65; the return movement of 221 against 220 is effected by return springs 66.

As in the first embodiment, the capture head 24 is mounted so as to pivot on the carriage 22 by means of a horizontal axle 28 parallel to the axis of the winding cylinder. However, the head 24 can occupy two anchoring positions corresonding to the spindles 1 and 101. Its pivoting movement is controlled by a jack 29 (FIG. 13) with three positions. The nozzle 23, the means for mounting it on the head 24 and the cutting means are identical to those of the first embodiment.

The loading/unloading unit 10 carries the removal spindle 13 and the loading spindle 14 which are identical, with regard to their construction and their control, to those of the first embodiment. Likewise, the unit 10 can pivot about the axle 11 between a position for removing the coil and one for placing an empty support in position, and can effect a translational movement in a direction parallel to the axis of the pilot cylinder. When making this movement it is guided by two cylindrical sliding-posts 21 (FIGS. 12 and 15) parallel to the axle 11. The sliding-posts 21 are carried by a U-shaped support 67 which can travel vertically inside the framework 58 guided by two vertical columns 68 firmly fixed to the framework 58. The vertical shift of the support 67 and consequently of the unit 10 enables the unit 10 to effect bobbin-changing on the two winding-up spindles 1 and 101 of the same winding-up station. The shifting movement is controlled by a jack 69. As in Example 1, a jack G controls the pivoting of the unit 10 about the axle 11, and a jack (not shown), which is similar to jack H, controls its sliding movement on the sliding-posts 21.

The operation of this second device takes place in accordance with the same procedure as with the device according to the first described embodiment.

The automatic sequence is a little more complex since it must incorporate, in addition, the control of the jack 65 (part 221 of the transfer carriage), of the double-action jack 29 (capture head), of the jack 69 (support 67 and unit 10) of the jack 61 (framework 58). Bobbin-changing is effected on the two spindles, one after the other in the course of two complete movements of the automaton.

Figure 16:
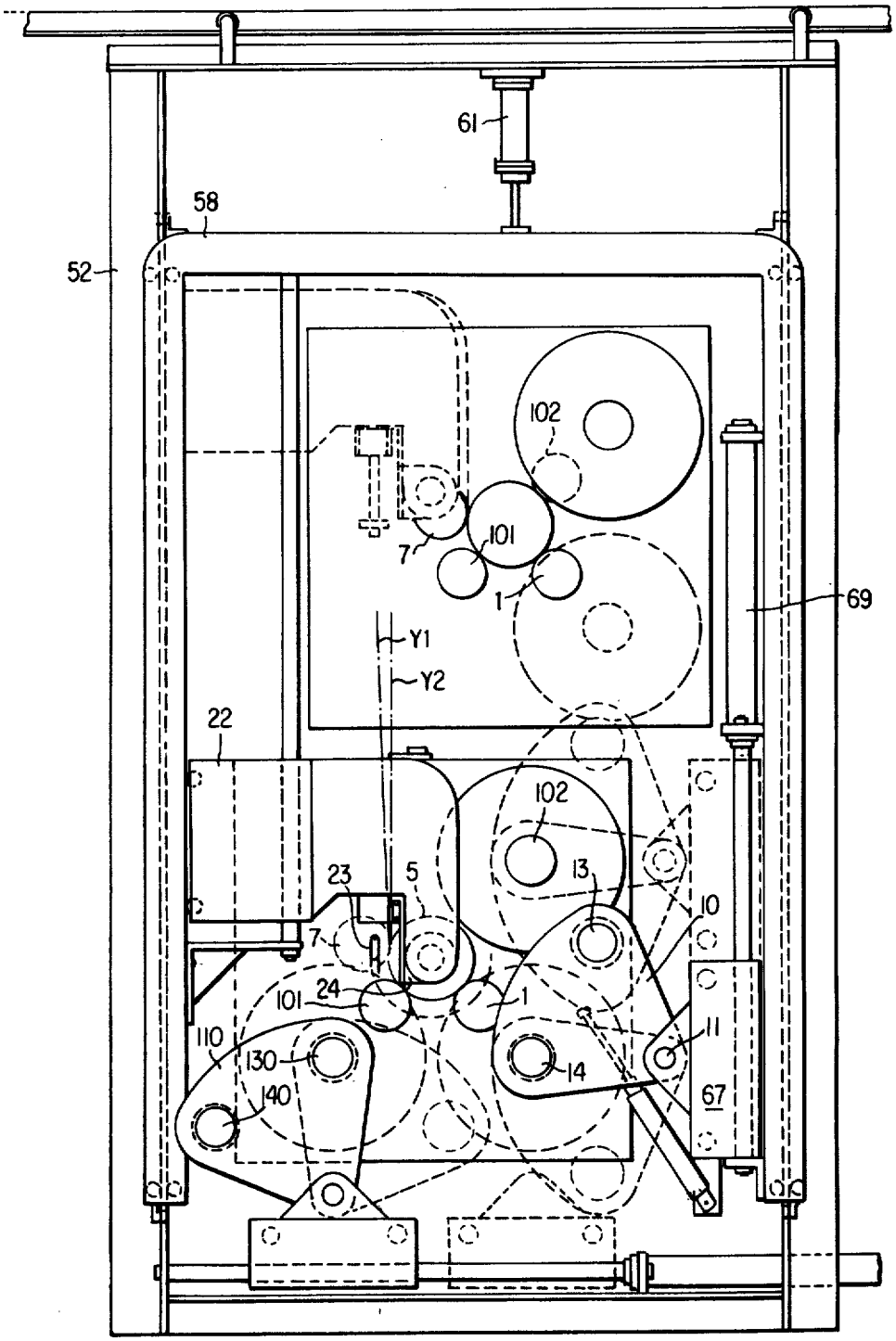
FIG. 16 is a rear elevation of a third embodiment of automaton according to the invention.

A third embodiment of the automaton is represented, as seen from the back, in FIG. 16. This embodiment is provided for effecting bobbin-changing on bobbin-winders of the type described in the first embodiment, but which have, at each winding-up station, three spindles to enable two yarns to be wound up simultaneously on two yarn supports. Each winding-up station of the bobbin-winder thus comprises a winding cylinder 5, three spindles 1, 101 and 102, and a reciprocating distribution device 7 with a single yarn guide common to the three spindles. The spindles 1 and 102 are positioned on the same vertical plane and the spindles 1 and 101 are on the same horizontal plane. The winding-up stations are positioned on two different levels. The automaton is similar to the second embodiment. It differs therefrom, however, in the following construction characteristics:

The capture head 24 can occupy four positions (a rest position and three positions for effecting anchoring on 1, 101 and 102). It is controlled by a jack with four positions. The loading/unloading unit consists of a combination formed from two units such as the unit 10 of the first described embodiment. The second unit 110 effects a translational movement on a horizontal sliding-post firmly fixed to the framework 58. The two units 10 and 110 can occupy two working positions. The unit 10 works on the spindles 1 and 102 and the unit 110 on the spindles 1 and 101. The bobbin-changing positions for the spindles 101 and 102 correspond to positions for parking the two units 10 and 110, with respect to the spindle 1.

This device can operate in the following way:

Two yarns Y 1 and Y 2, coming from the same spinneret, are wound up on the same winding-up station. The operations on the two yarns Y 1 and Y 2 are begun simultaneously and the two packages which they form are completed at the same time. From the start, the following restriction is imposed: Y 1 is wound up either on the spindle 1 or on the spindle 101, and Y 2 is wound up either on the spindle 1 or on the spindle 102. Thus, during operation, it is possible to have two combinations of yarn/spindle pairs, either: (Y 1 on 1) and (Y 2 on 102), or: (Y 1 on 101) and (Y 2 on 1). The automatic sequence at this level requires two programmes, depending on whether it is a question of going from the first to the second combination or vice versa. The first starting up procedure, at the beginning of the operation, is effected manually.

Let us suppose that the bobbin-changing operation is to be carried out when Y 1 is wound up on 101 and Y 2 on 1. The spindle 102, in the stopped position, is provided with an empty tube. The automaton, having been brought into the working position, detects the spindle in the stopped position (102 in the present case) and, based on the facts detected, chooses the appropriate bobbin-changing programme. This detection can be effected by sensing the pressure of air supplying the turbine. The automaton gives the order to start up the spindle 102. The unit 10 comes into the working position. After starting up the movement of the spindle 102, the nozzle 23 takes up the yarn Y 2 and, as in the case of the first described embodiment, transfers the yarn to the said spindle. Simultaneously, the automaton gives the order to stop the spindle 1. After it has stopped, its coil is removed by means of the removal spindle 13 of the unit 10, in accordance with the principle described in the aforementioned first embodiment. An empty tube is placed in position on the spindle 1, by means of the loading spindle 14. The unit 10 passes to the parking position. The unit 110 comes into the working position. The automaton gives the order to start up the spindle 1. After starting up the movement of this spindle, the nozzle 23 grips the yarn Y 1 and transfers it to the said spindle 1. Simultaneously, the automaton gives the order to stop the spindle 101. After it has stopped, the package 301 which the spindle 101 carries is removed by means of the removal spindle 130 of the unit 110 and an empty tube is placed in position by the loading spindle 140, in accordance with the principle described in the first embodiment. The spindle 101 remains in the stopped position. The automaton loaded with two packages returns to the waiting position, on a fixed station which provides for the full packages to be removed and for two empty tubes to be placed in position.

The situation has thus changed from winding up Y 1 on 101 and Y 2 on 1, to winding up Y 1 on 1 and Y 2 on 102. The reverse operation is effected in accordance with a similar procedure controlled by a second programme incorporated into the automaton.

By means of this third embodiment, yarn wastage is reduced to a large extent. The loss in the case of each yarn corresponds to the time taken for the nozzle to pass from the capture position to the position for effecting anchoring on the support; this period of time is approximately 5 seconds. Furthermore, only one complete movement is necessary to effect bobbin-changing on two spindles, instead of two complete movements in the first and second embodiments.

Figure 22:
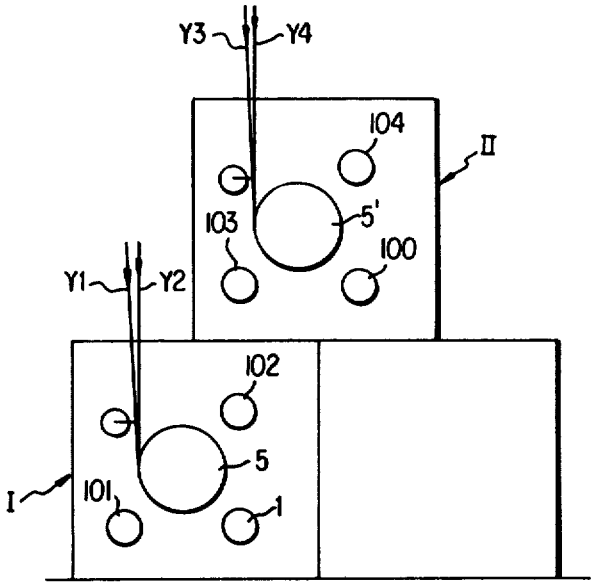
FIG. 22 is a diagrammatic view of a set of bobbin-winders and winding up stations on which a bobbin-changing operation is to be effected.
Figure 23:
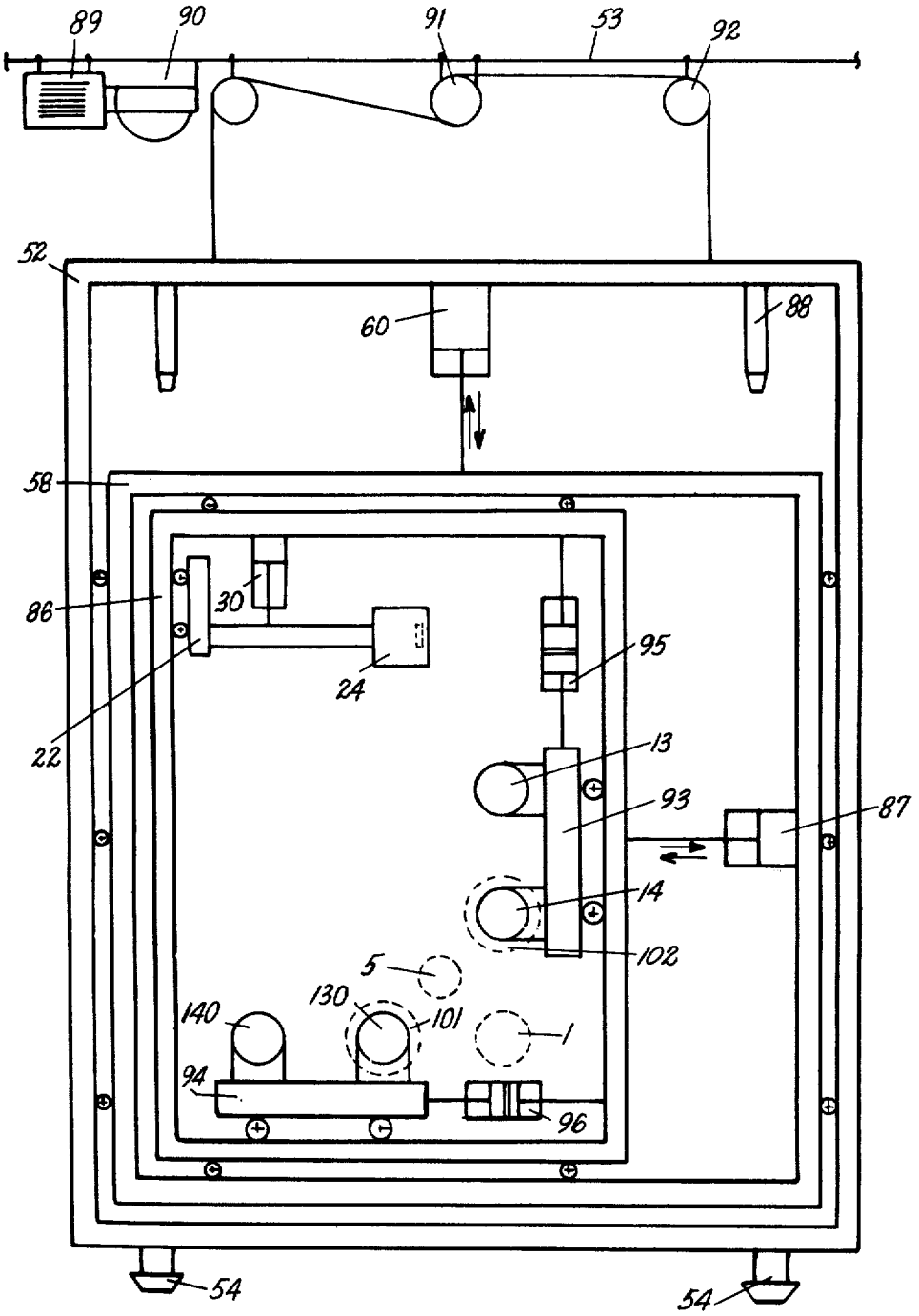
FIG. 23 is a diagrammatic view of a fourth embodiment of automaton according to the invention.

This forth embodiment makes it possible to effect bobbin-changing on four spindles during a single complete movement of the automaton. The procedure is carried out starting with four yarns which come from the same spinneret and on which the operations are begun simultaneously, the first starting up procedure being effected manually. According to the working procedure, each spinning mishap affecting one yarn has repercussions on the other three (for example, if one yarn breaks as it leaves the spinneret, it is necessary to take up all four yarns again and to begin the operations on all of them again). In this way, the four packages are completed at the same time. As can be seen in FIG. 22, the four yarns Y 1, Y 2, Y 3 and Y 4 are wound up two by two on two winding-up stations I and II which are superposed but staggered longitudinally in order to have free yarn passages for the lower stations. In the braking position, the spindles 1 and 101 are on the same horizontal plane, and the spindles 1 and 102 are on the same vertical plane. The same applies to the spindles 101 and 103, and 100 and 104. The automaton is represented in FIG. 23.

As in Examples 2 and 3, the frame of the automaton consists of a large framework 52 which can move along an overhead rail 53 by means of an electric motor 89 and a friction roller 90. It is suspended from the rail by means of a system comprising a cable, a pulley-block 91 and pulleys 92, so as to occupy a high position and a low position or working position. The high position is used during shifting movements of the automaton which can thus travel in front of the row of bobbin-winders without getting in the way of operators who may be on the ground.

A second framework 58 is positioned in the framework 52 and can shift vertically inside the latter. This shifting movement is effected by means of the jack 60. The framework 59 itself carries a framework 86 which can shift horizontally in the said framework 58, by means of a control jack 87. The combination comprising the transfer carriage 22, the capture head 24 and the nozzle 23 is identical to that according to the embodiments 2 and 3; it shifts vertically inside the framework 86; its movement is controlled by the jack 30. The loading/unloading unit comprises two carriages 93 and 94 which can effect translational movements respectively on a vertical side and on a horizontal side of the framework 86. The carriage 93 is moved by a jack with three positions 95 and the carriage 94 by a jack with three positions 96. Each of the jacks 93 and 94 carries two spindles, 13 and 14, and 130 and 140 respectively. The four spindles are identical to the removal spindle used in Examples 2 and 3 and represented in FIG. 5. This spindle can grip a full package or empty yarn support tube and can transfer the tube onto itself (by means of the claws 16). It can also eject this tube by means of the sliding stops 33.

For the bobbin-changing operation, by way of example, the following restrictions are imposed a priori:

a. Y1 is wound up either on 1 or on 101,
Y2 is wound up either on 1 or on 102,
Y 3 is wound up either on 100 or on 103 and
Y4 is wound up either on 100 or on 104.

b. The following pairs of spindles are used simultaneously:
1 and 101 with 100 and 104, and thereafter:
1 and 102 with 100 and 103.

c. The spindle at rest on each station is an empty spindle without an empty tube.

Let us suppose that bobbin-changing operations have to be effected on the two pairs of spindles 1–101 and 100–104. The automaton loaded with four empty tubes positions itself in front of the two stations I and II. As in embodiment 3, it detects the spindle in the stopped position (103 in the present case) and selects the appropriate bobbin-changing programme which can take place in accordance with the following procedure:

The spindle of the automaton 140 places an empty tube on the winding-up spindle 103 which is started up. As it is gaining speed (20 to 30 seconds), the framework 58 descends opposite the station I and the spindle 13 station places an empty tube on the spindle 102 which is started up. The framework 58 rises again opposite the station II, and, 103 having reached its normal running speed, the nozzle grips the yarn Y3 going onto 100 and transfers it onto 103; simultaneously, the automaton sends the stop signal for 100. The framework 58 descends opposite the station I, and the nozzle grips the yarn Y2 and transfers it onto 102; simultaneously, the spindle 1 receives the stop order. The framework 58 rises again opposite the station II and the spindle 13 removes the package from the spindle 100. The spindle 14 loads the spindle 100 with an empty tube; the spindle 100 is started up. Whilst the spindle 100 is gaining speed, the framework 58 descends opposite the station I. The package on the spindle 1 is unloaded by means of the spindle 140 and the spindle 130 places an empty tube on the spindle 1; the spindle 1 is started up. The framework 58 rises again opposite the station II, and the nozzle grips the yarn Y4 going towards 104 and transfers it onto 100; simultaneously, 104 receives the stop order. The framework 58 descends opposite the station I. The nozzle grips the yarn Y1 going towards 101 and transfers it onto 1; simultaneously, the stop order is sent to the spindle 101. The framework 58 rises again opposite the station II, and the spindle 14 removes the package formed on the spindle 104. The framework 58 descends again opposite the station I and the spindle 130 removes the coil formed on the spindle 101. The bobbin-changing operation is complete. The automaton loaded with the four packages returns to the waiting position at the end of the winding machine where it unloads the full tubes and loads itself up again with empty tubes.

This procedure makes it possible to effect bobbin-changing operations on four spindles in two minutes 45 seconds (period of time to immobilise the automaton in front of the stations on which bobbin-changing has to be effected). As in the embodiment 3, the loss of yarn, connected only with the transfer from spindle to spindle, is minimal; it corresponds to a passage time of approximately 5 seconds. The shifts of the automaton are reduced since it conveys four pagkages at once, instead of two in embodiment 3.

Other procedures can obviously be envisaged. Furthermore, the reverse operation, that is to say changing from the pairs 1–102 and 100–103 to the pairs 1–101 and 100–104, takes place in accordance with a similar procedure.

In the four embodiments, the jacks can be pneumatic or hydraulic and can be supplied with energy by means of flexible pipelines from a fixed energy source situated in the vicinity of the bobbin-winders on which the bobbin-changing operation has to be effected or from an independent energy generating device firmly fixed to the automaton.

The automoton is provided with a waste receptacle (for example a waste bag) connected to the nozzle.

Automatic operation can be achieved by means of pneumatic and/or electronic logic systems. The transmission of an order from the automaton to the bobbin-winder and vice versa can be carried out by means of mechanical contacts, or fluid or magnetic cells, or in accordance with the system represented in FIGS. 17 and 18 and described elsewhere, or the like.

Preferential means for carrying out the automatic sequences of the automaton according to the example and of the bobbin-winder are represented in FIGS. 24 to 27.

For actuating the components of the automaton, the jacks comprise a single-action jack D drawn back by a spring for actuating the claws 16 of the removal spindle 13, and double-action jacks for actuating the other components, the jack 27 which controls the forward movement of the nozzle being a jack with four positions. The preferred means for carrying out the automatic sequence of the automaton comprise a pneumatic distributor with a memory, associated with each double-action jack, alternately controlling the supply to each side of the chamber of the corresponding jack.

Figure 24:
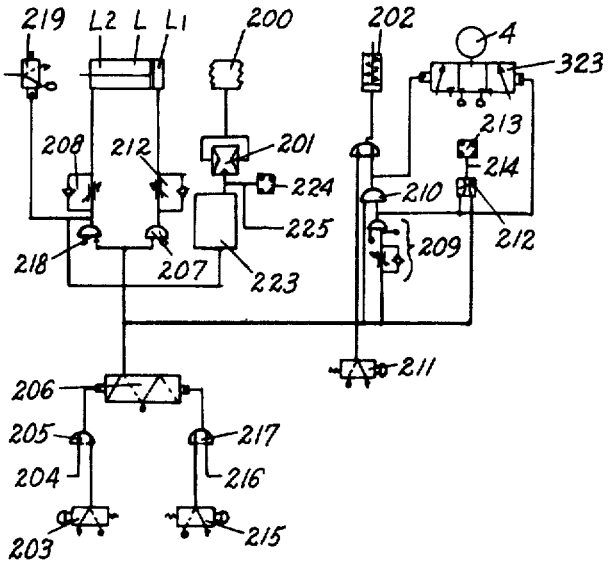
FIG. 24 is a circuit diagram of the means for effecting an automatic sequence characteristic of the bobbin winder on which a bobbin-changing operation is to be effected.
Figure 27:
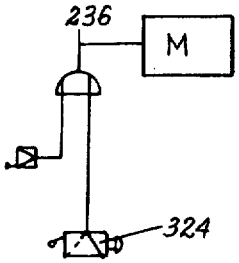
FIG. 27 is a diagram of the control means for starting up the automaton.

FIG. 24 represents the circuit for controlling the bobbin-winder in accordance with its automatic sequence carried out by means of pneumatic logic and in which pneumatic jacks are used. The jack L, which cannot be seen in FIGS. 1 and 2, controls the radial shift of the winding-up spindle 1. 219 is a valve for controlling the mist of lubricating oil. 201 is a vacuum generator for retracting the gripping sleeve 200 which is not shown in FIGS. 1 and 2. A jack 202 controls the outward movement of the arresting stop (brake 6).

The bobbin-winder is started up either by manual control from an impulse switch 203, or from a signal 204 emitted by the automaton. Either one of these signals, via a cell 205 with an "or" logic function, controls the rocking of a pneumatic control distributor 206 with a memory function. The permanent pneumatic signal emitted by distributor 206 controls via a cell 207 with a "yes" logic function the supply of compressed air to the side L1 of the chamber of the jack L. The shift of the rod of the jack which results from this causes the spindle 1 to move closer to the winding cylinder 5. The jack is a slow-moving jack, the air escaping from the side L2 of the chamber through a flow rate reducer 208. Simultaneously, the same signal emitted by distributor 206 is conveyed to the polarisation input of a "no" cell 210, to a delay device 209, connected to the second input of the "no" cell 210 and to a retarder 212. While the delay device is in action, the "no" cell 210 emits an output signal which triggers the air supply of the jack 202 (outward movement of the arresting stop) and controls the supply of air under high pressure (6 bars) to the power distributor 323 in order to start up the turbine 4. When the delay device 209 ceases to act, it emits an output signal which:

a. enters the "no" cell 210; this cell ceases to emit an output signal, and this stops the supply of air to the jack 202 (return movement of the arresting stop) and stops the supply of air under high pressure to the turbine 4;

b. simultaneously causes the distributor 323 to rock and consequently causes the turbine to be supplied with air under low pressure; and c. enters the retarder 212. After a set period of time, the retarder 212 lights up an indicator 213 and emits a signal 214 in the direction of the automaton.

The stopping of the bobbin-winder is controlled either from a manual switch 215 of from a signal 216 emitted by the automaton. One of these signals, via an "or" cell 217, causes the memory distributor 206 to rock and this distributor then ceases to emit a signal. The absence of a signal triggers the following operations:

a. Via a "no" cell 218 which then emits an output signal:

i. closure of the oil mist valve 219;

ii. supply of the side L2 of the chamber of the jack L, which causes the rod of the jack to execute a return movement and the spindle to be brought onto the brake. 212 is a flow rate reducer to enable the fluid to escape slowly from the chamber L1, and iii. entry of the signal emitted by 218 into a delay device 223 which then emits an output signal which controls the vacuum generator 201 which causes the sleeve 200 to contact; the package can then be removed from the spindle. The same output signal lights up an indicator 224 and gives an order 225 to the automaton.

b. The absence of a signal at the output of distributor 206 leads to stoppage of the supply to the turbine, cessation of the emission of the signal 214 and depolarisation of the "no" cell 210, and extinguishes the indicator 213.

Figure 25:
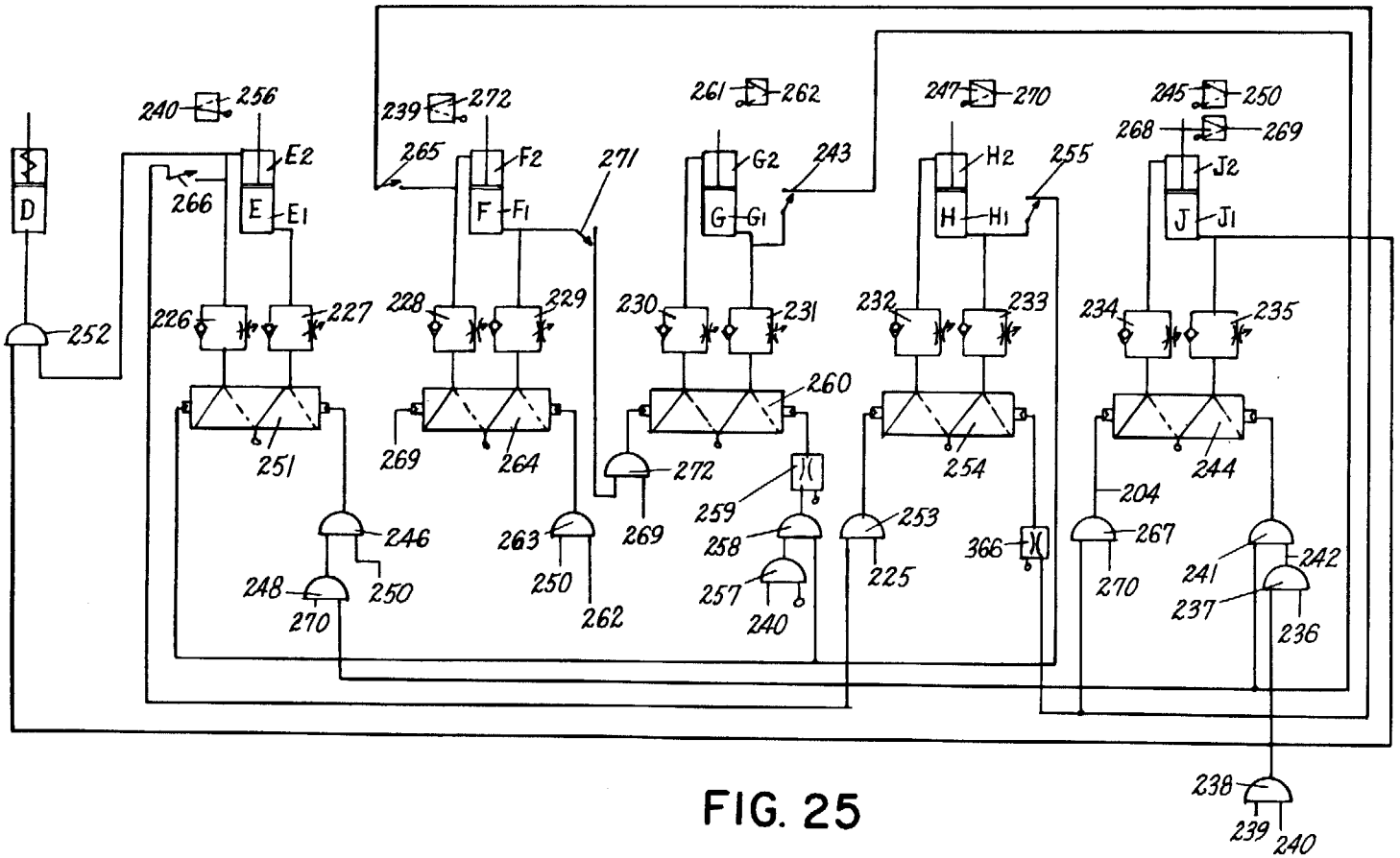
FIG. 25 is a partial circuit diagram of the means for effecting an automatic sequence of the automaton according to FIGS. 3 and 4.

FIG. 25 is a diagram of the means for carrying out the automatic sequence for the control of the components of the loading/unloading unit.

As has already been stated, the jacks E, F, G, H and J are double-action jacks, and the jack D is a single-action jack drawn back by a spring. The compressed air is removed from the chambers of the jacks E, F, G, H and J via flow rate reducers 226 to 235, in order that the rods of the jacks move slowly and not jerkily. At the start, the loading/unloading unit 10 is in the vertical position.

The automaton is started up from a signal 236 which can be emitted either by a manual control 324 of from a timer M (FIG. 7). The signal 236 enters a cell 237 with an "and" logic function. The other input of the cell 237 receives a signal from the "and" cell 238 which receives two safety signals 239 and 240 corresponding to the presence of an empty tube in the loading spindle 14 and to the absence of a full bobbin on the removal spindle 13. A signal 242 is collected at the output of the cell 237, and this signal 242 simultaneously enters an "and" cell 241 and an "and" cell 283 (FIG. 26) for controlling the forward movement of the nozzle (FIG. 6). The jack G is at rest with its rod retracted. In this position, it emits a signal via an end-of-travel sensor 243. This signal enters the "and" cell 241 which, already receiving the signal 242, emits an output signal. The latter controls a pneumatic control distributor with a memory 244, which emits a permanent signal which triggers the supply of compressed air to the side J1 of the chamber of the jack J and consequently the rocking of the unit 10 into the horizontal position. The signal emitted at the output of 244 also enters an "and" cell 252 incorporated into the control of the jack D. The outward movement of the rod of the jack J actuates an end-of-travel switch 245 which emits a signal 250 which enters an "and" cell 246 incorporated into the control of the jack E, and an "and" cell 263 incorporated into the control of the jack F. The jack H, which is at rest, has its rod extended. In this position, it actuates a switch 247 which emits a signal 270 which enters an "and" cell 248 incorporated into the control of the jack E and an "and" cell 267 incorporated into the control of the jack J. The signal emitted by the jack G, at rest, also enters the cell 248. The latter, receiving two input signals, emits an output signal which enters the cell 246. The latter, already receiving the signal 250, emits an output signal which acts on a distributor with a memory 251 which controls the supply of compressed air to the side E1 of the chamber of the jack E. The slide-bar 15 is pushed to the end of the spindle 13. An end-of-travel sensor 266 then emits a signal which enters an "and" cell 253 incorporated into the control of the jack H. A cell 253 also receives the signal 225 which comes from the bobbin-winder and is emitted when the sleeve of the spindle is in the contracted position (FIG. 4). The "and" cell 253, being supplied at both its inputs, emits an output signal which controls a distributor with a memory 254 which emits a signal for controlling the supply of air to the chamber H2 of the jack H. The shift of the rod which results from this causes the bobbin-changing unit 10 to slide towards the bobbin-winder and causes the nose 150 of the spindle 13 to penetrate into the end of the tube 2. At the end of the travel of the rod of the jack H, and end-of-travel sensor 255 emits a signal which causes the distributor with a memory 251 to rock. This signal also again enters an "and" cell 258 incorporated into the control of the jack G. The distributor 251 emits a signal which controls the supply to the chamber E2 of the jack E, and which also enters the "and" cell 252. The latter, already receiving a signal coming from the distributor 244, emits an output signal which controls the supply to the jack D, and consequently the expansion of the claws 16 which penetrate into the wall of the tube. The chamber E2 being supplied, the jack E returns to its original state, its rod driving the slide-bar 16 and the full bobbin onto the removal spindle 13. When the bobbin is in position on the spindle 13, it triggers an end-of-travel contactor 256, which cuts off the safety signal 240. The absence of a signal acts on the "no" cell 257 incorporated into the control of the jack G which emits a signal which enters the "and" cell 258. The cell 258, receiving two input signals, emits an output signal which enters a retarder 259. After a delay, which can be adjusted, of approximately 5/10ths of a second, 259 sends a signal to a distributor with a memory 260 which emits a signal which controls the supply to the side G1 of the chamber of the jack G. The bobbin-changing unit rocks about the axle 11, and the spindle for effecting a positioning operation 14 locates itself opposite the spindle 1. The rod of the jack G actuates an end-of-travel switch 261 which emits a signal 262 which enters the "and" cell 263. The latter, already receiving the signal 250 coming from 245 (rod of the jack J extended), emits an output signal which causes a distributor with a memory 264 to rock, and this distributor controls the supply of compressed air to the chamber F1 of the jack F. The rod of F acts on the push-rod 19 which pushes the empty tube onto the spindle 1. At the end of its travel, the rod of the jack F actuates a switch 272 which cuts off the safety signal 239; it also actuates an end-of-travel sensor 265 which sends a signal to a retarder 366 associated with the control of the jack H and to an "and" cell 267 incorporated into the control of the jack J. The retarder 366 controls the rocking of the distributor 254 which controls the supply of compressed air to the side H1 of the chamber of the jack H and consequently the backward movement of the bobbin-changing unit 10. The movement of the rod of the jack H acts on the end-of-travel contactor 247 which emits a signal 270 which enters the "and" cell 248 and the "and" cell 267; the latter, already receiving a signal coming from the sensor 265, emits an output signal 204 which simultaneously enters the distributor 244 and is sent to the bobbin winder. This signal 204 fulfils two functions:

a. it triggers the starting up of the bobbin-winder (FIG. 4), and b. it causes the distributor with a memory 244 to rock, this distributor controlling the supply of compressed air to the side J2 of the chamber of the jack J, and it causes the bobbin-changing unit 10 to return to the vertical position. In the retracted position, the rod of the jack J acts on a contactor 268 which emits a signal 269 which controls the second stage of carrying out the automatic cycle relating to the transfer operation (FIG. 6) and which causes the distributor with a memory 264 to rock, this distributor controlling the supply of compressed air to the chamber F2 of the jack F and consequently the return movement of the push-rod 19 to inside the spindle 14. The rocking of 244 has also cut off the signal which it was sending to the cell 252 and the latter cuts off the supply of air to the jack D which assumes the retracted position under the effect of the return spring. The claws leave the full bobbin. An end-of-travel sensor 271, on the jack F, emits a signal which enters an "and" cell 272 incorporated into the control of the jack G. The cell 272, also receiving the signal 269 coming from the jack J with its rod retracted, emits an output signal which triggers the rocking of the distributor 260 which controls the supply of air to the side G2 of the chamber of the jack G and consequently the rocking of the unit 10 about the axle 11 so as to resume its initial position.

The end-of-travel sensor 243 then emits a signal which enters the cell 241 and the cell 248. After removing the full bobbin and placing an empty tube in position in the spindle 14, the automaton is ready for a new work cycle.

FIG. 26 is a diagram of the means for carrying out the automatic sequence for controlling the nozzle 13, the capture head 24 and the transfer carriage 22.

The nozzle is made to slide horizontally by means of the double-action four-position jack 27 having two chambers represented at 27' and 27'' by two separate jacks. As before, air escapes from the jacks 26, 27, 27', 29 and 30 via flow rate reducers 273 to 282 in order that the rods of the jacks move slowly and not jerkily.

As indicated with reference to FIG. 25, the signal 242 emitted by the cell 237, when the automaton is starting up, enters the "and" cell 283 incorporated into the control of the jack 27'. The jack 26, being at rest with its rod retracted, emits a signal via an end-of-travel contactor 284. The said signal enters an "and" cell 285 incorporated into the control of a central distributor 286 with a memory, an "and" cell 287 incorporated into the control of the jack 27'', and a cell 288 incorporated into the control of the jack 30. The jack 30, being at rest with its rod extended, emits a signal via an end-of-travel sensor 325, which enters an "and" cell 289, incorporated into the control of the jack 27', and an "and" cell 290. The output 286 of the central distributor 286 emits a signal which enters the cell 283, the "and" cells 287 and 291 incorporated into the control of the jack 27'', a cell 292 incorporated into the control of the jack 29, a cell 293 incorporated into the control of the jack 26, and a cell 308 incorporated into the control of a distributor 312. The "and" cell 283, receiving two signals (242 and the signal coming from 286), emits an output signal which enters the cell 289. The latter, also receiving two signals, one of which is from the jack 30, emits a signal which causes a pneumatic distributor with a memory 294 to rock, and this distributor controls the supply to the side 27a of the chamber of the jack 27. The large forward movement of the nozzle is thus brought about. An end-of-travel sensor 295 then sends a signal to the cell 293 which, receiving two input signals, emits an output signal to a distributor with a memory 296 controlling the supply of compressed air to the side 26a of the chamber of the jack 26 and consequently the pivoting of the nozzle about the axle 25. At the end of the travel of the rod of the jack 26, a sensor 297 emits a signal which enters an "and" cell 298 incorporated into the control of the central distributor 286, the cell 291, and a distributor 321 incorporated into the control 322 of the air supply to the nozzle. The cell 291, already receiving a signal coming from 286, emits an output signal which, via an "or" cell 299 causes a distributor 304 to rock, and this distributor controls the supply of air to the side **27''*a* of the chamber of the jack 27'' and the small forward movement of the nozzle, so as to take up the yarn. The signal sent to the distributor 321*a* causes air to be supplied to the nozzle. The yarn is gripped and is removed to the waste receptacle. The outward movement of the rod of the jack 27'' leads, via an end-of-travel sensor 305, to the emission of a signal which enters the "and" cells 290, 298, and 285, and an "and" cell 306 incorporated into the control of the supply of air to the nozzle. The cell 290, receiving two input signals (one of which comes from the jack 30 with its rod extended), emits an output signal 216 which triggers the stop sequence of the bobbin-winder (FIG. 24**).

Likewise, the cell 198, receiving two input signals (one of which comes from the jack 26 with its rod extended), emits an output signal which triggers the rocking of the central distributor 286 which sends out a permanent signal at 286+. The jack 29 is at rest with its rod extended. In this position, it emits a signal via the end-of-travel sensor 307, and this signal enters the "and" cell 308 incorporated into the control of the jack 30, and the "and" cell 309 incorporated into the control of the jack 27''. The cell 309, also receiving a signal coming from the central distributor 286, emits an output signal which enters an "or" cell 310 which controls the rocking of the distributor 304 and the supply of air to the side **27''*b* of the chamber of the jack 27''. The backward movement of the nozzle over its small path is thus brought about. Simultaneously, the rocking of the distributor 286 causes the distributor 294 to rock and air to be supplied to the chamber 27'*b* of the jack 27'. The complete backward movement of the nozzle is thus brought about. At the same time as the above two operations, the central distributor 286, via the distributor 296, causes the rod of the jack 26 to be retracted and the nozzle to pivot into the horizontal position. The nozzle sucking up the yarn resumes its initial position and remains in this position whilst the unit 10** effects the bobbin-changing operation.

After the operations involving removing the full bobbin and placing an empty tube in position on the spindle 1, a signal 204 (FIGS. 24 and 25) gives the order for the bobbin-winder to start up and a signal 269 controls the second stage of the automatic cycle relating to the transfer operation. The signal 269 enters the "and" cell 311 which is already receiving a signal from the "and" cell 288 which receives two signals (one coming from the central distributor 286 and the other coming from the end-of-travel sensor 284 of the jack 26 with its rod extended). The cell 311 controls the rocking of a distributor with a memory 312 which controls the supply of compressed air to the side **30*b* of the jack 30. The transfer carriage 22 descends and locates itself in the position for anchoring the yarn. At the end of travel, a signal emitted by the sensor 313 is sent to an "and" cell 314 incorporated into the control of the jack 29, and to the "and" cell 306. The cell 314, already receiving a signal coming from the distributor 286, emits an output signal which causes a distributor 315 to rock, and this distributor controls the supply of air to the side 29***b* of the chamber of the jack 29 and the rotation of the capture head 24 about the axle 28. When the spindle 1 of the bobbin-winder has reached its operating speed, it emits a signal 214 (FIG. 24) which enters an "and" cell 316. The latter cell receives a second signal coming from an "and" cell 317 which receives a first signal coming from the central distributor 286 and a second signal coming from an end-of-travel sensor 318 associated with the jack 29. The cell 316 thus emits an output signal which enters the "or" cell 299 which controls the rocking of the distributor 304 and the supply of air to the side 27''*a* of the chamber of the jack 27''. As a result of this, the jack 27'' causes the small forward movement of the nozzle, the nose of which extends into the zone X of the support 2 projecting beyond the spindle 1. Since the support 2 is equipped with an anchoring slit, the yarn becomes anchored on the support and the package begins to form.

The end-of-travel sensor 305 associated with the jack 27'' emits a signal which enters the "and" cell 306 which, already receiving a signal from the sensor 313, triggers the rocking of the distributor 321 which, after a delay, provided by a retarder 319, cuts off the air supply 322 of the nozzle. The signal emitted by the sensor 305 also again enters the "and" cells 298 and 285 (control of the central distributor). The cell 285, already receiving a signal coming from the sensor 284 (jack 26 with its rod retracted), emits a signal which causes the distributor 286 to rock and a signal to be sent out from 286$^-$. This signal enters the "and" cell 287, which is already receiving a signal coming from the contactor 284. The cell 287 emits a signal which again enters the "or" cell 310 which causes the distributor 304 to rock and consequently causes the rod of the jack 27' to be retracted (short path of the nozzle). This retraction causes an end-of-travel signal to be emitted by the sensor 320, and this signal again enters the "and" cell 292. The latter, already receiving a signal coming from 286$^-$, emits an output signal which causes the distributor 315, which controls the supply of air to the side 29*a* of the chamber of the jack 29, to rock, thus causing the capture head 24 to pivot about the axle 28. The head 24 resumes its initial position on the transfer carriage 22. The outward movement of the rod of the jack 29 causes a signal to be emitted by the end-of-travel sensor 307, and this signal enters the "and" cell 308. The latter, already receiving a signal coming from 286$^-$, emits an output signal which causes the distributor 312 to rock, this distributor controlling the supply of compressed air to the side 30*a* of the chamber of the jack 30. The bobbin-changing carriage 22 is brought back to its original position (called the position "for taking up the yarn"). The transfer operation is complete.

Following the principle of the above control means, it is possible to produce means for effecting automatic control of all the embodiments of the automaton described in the application.

The automaton advantageously serves several bobbin-winders, for example a complete row; the operation may be effected in the following way:

A switch, triggered by the increase in size of the bobbin or by a timer, sends an order to a waiting series in a central memory. In the order in which it is called, the automaton will locate itself at the position which calls it. By way of an example of operating conditions, in the case of an automaton of the type of Example 1 or 2 serving 48 bobbins, the total average working time being two minutes, taking into account the time involved in shifting the automaton, and the duration of the bobbin-winding operation being two hours thirty minutes, for a coil weight of approximately 15 kg, the automaton would be loaded to the extent of 58%. If the bobbins are set 400 g below the maximum possible weight, namely 15 kg, there are only four chances out of 10,000 that the waiting series would be too long and that the bobbin-winder would trigger the safety stop on a second switch when the bobbin has reached its maximum diameter.

With the embodiments 1 or 2, the total time for the bobbin-changing operation (not including the time involved in shifting the automaton) is less than one minute. In the case of the embodiments 3 and a fortiori 4, the performance is improved since, in the case of the embodiment 4, a bobbin-changing operation is effected on four coils in two minutes 45 seconds. The device operates for speeds of the order of 4,000 meters/minute and more, with a yarn of 167 dtex/30 strands, a nozzle of length 150 mm and thickness 10 mm, and a yarn channel, the cross-section of which varies from 40 mm$^2$ to 65 mm$^2$ from one end to the other. The nozzle is supplied with compressed air at a pressure of 6 bars (read on the manometer). At 4,200 meters/minute, the air flow rate is substantially of the order of 60 Nm$^3$/hour. Only the efficiency of the nozzle which takes up the yarn can limit the speed. With sufficiently high air flow rates and pressures it is possible to achieve 6,000 to 7,000 meters/minute and more, without difficulty.

The device is suitable for effecting bobbin-changing on packages which can weigh as much as 20 kg and more. In this field, the only limitations are the mechanical strength and the dimensions of the combination.

The value of the invention can be seen since, by means of the combination of the elements described and in particular the use of the capture nozzle, it makes it possible to effect bobbin-changing on bobbin-winders winding up yarn at very high speed (6,000 to 7,000 meters/minutes and more), and this has never been achieved hitherto. The operation is carried out with complete reliability and with a minimum amount of waste. By way of example, in the case of a device according to embodiment 1 or 2, forming 40 seconds of waste at each bobbin-changing operation, the winding up of a semi-stretched yarn of 250 dtex/30 strands, at a speed of 3,600 meters/minute, gives a yarn loss of 60 g at each bobbin-changing operation. Considering that packages of 16.2 kg are formed, the waste is substantially equal to 0.37%, which is minimal. This waste is even further reduced and is practically zero with the third and fourth embodiments. Moreover, the division of the automatic system into a bobbin-winder sequence and an automaton sequence makes it possible to utilise the bobbin-winder under manual control should the automaton by any chance break down.

The invention can be applied to effecting bobbin-changing on bobbin-winders winding yarns of any nature (synthetic or natural fibres), of any type (continuous yarn or yarns spun from fibres) and of any gauge.

Many equivalent modifications will become apparent to those in the art from a reading of the above without a departure from the inventive concept.

What is claimed is:

1. In an apparatus for automatic bobbin changing on a high speed frontal bobbin winder having a frame with at least one winding-up station, at least one yarn support gripping spindle with a horizontal axis, a rotatable winding cylinder mounted for movement into and out of tangential engagement with a package forming on a yarn support on said spindle, a fixed yarn guide and a reciprocable yarn guide for distributing yarn along the yarn support, the improvement which comprises a loading and unloading means mounted on a frame for movement in a directon parallel to the front of the bobbin winder, said loading and unloading means including at least two parallel spindles, one of said spindles being provided for removing a wound yarn package from the yarn support gripping spindle and another of said spindles being provided for placing an empty yarn support on said gripping spindle, said parallel spindles being movable in turn into an aligned position in axial alignment with a yarn support gripping spindle of said frame;

nozzle means for capturing and removing the yarn fed to the yarn support, said nozzle means having a rectilinear capture slit communicating with a channel through which a stream of fluid may be fed at high speed and means for cutting the yarn mounted at the bottom of said slit;

means on said frame for mounting the nozzle means parallel to the axis of said winding cylinder so that it is movable between a capture position in which the slit extends in a plane including the reciprocating yarn between the fixed guide and the reciprocable guide, to capture a yarn as it moves from the fixed guide to the reciprocable guide and a second position adjacent said aligned position, to engage the captured yarn on an empty yarn support carried by said gripping spindle.

2. High speed frontal bobbin winding apparatus having a frame comprising at least one winding-up station mounted on said frame, at least one yarn support gripping spindle with a horizontal axis mounted on said frame proximate said winding-up station, said gripping spindle having a yarn support member, a rotatable winding cylinder mounted on said frame for movement into and out of tangential engagement with a package forming on said yarn support member on said spindle, a fixed yarn guide and a reciprocable yarn guide mounted on said frame behind the winding station for distributing yarn along the yarn support member in a triangular plane of movement, a loading and unloading means mounted on a frame for movement in a direction parallel to the front of the bobbin winder, said loading and unloading means including at least two parallel spindles mounted on a frame, one of said spindles being provided for removing a wound yarn package from the yarn support gripping spindle and another of said spindles being provided for placing an empty yarn support in said yarn gripping spindle, said parallel spindles being movable in turn into an aligned portion in axial alignment with said yarn gripping spindle, a nozzle for capturing and removing the yarn fed to the yarn support, said nozzle having a rectilinear capture slit communicating with a channel through which a stream of fluid may be fed at high speed, means for cutting the yarn mounted at the bottom of said slit and means on said frame for mounting the nozzle parallel to the axis of said winding cylinder so that it is movable between a capture position, in which the slit extends to a plane including the reciprocating yarn between the fixed guide and reciprocable guide, to capture a yarn as it moves from the fixed guide to the reciprocable guide and a second position adjacent said gripping spindle to engage the captured yarn on an empty yarn support carried by said gripping spindle.

3. Apparatus according to claim 2, wherein the yarn support mounted on the gripping spindle projects beyond the spindle, the reciprocable guide being behind the winding cylinder and the spindle being behind the reciprocable yarn guide, the capture nozzle being mounted so as to pivot and slide on a capture head which itself pivots between a resting position and at least one anchoring position about an axle parallel to the axis of the winding cylinder, the pivoting axle of the head being firmly fixed to a transfer carriage which effects a vertical translational movement.

4. Apparatus according to claim 3, wherein said capture head further effects a translational movement in a direction perpendicular to the axis of said winding cylinder.

5. Apparatus according to claim 3, wherein said capture nozzle is mounted on said capture head so as to pivot on the said head about an axle situated in a plane perpendicular to the axis of said winding cylinder and to slide in a direction parallel to the axis of the winding cylinder.

6. Apparatus according to claim 2, wherein the loading and unloading means comprises at least one assembly comprising two firmly fixed spindles, parallel to the axis of said winding cylinder and hinged about a common axle parallel to the axis of the said winding cylinder, whereby said assembly can effect a translational movement on the frame in a direction parallel to the axis of the winding cylinder.

7. Apparatus according to claim 6, wherein the set of two spindles also effects a translational movement in a vertical direction.

8. Apparatus according to claim 6, wherein the loading and unloading means comprises two sets of two spindles, one set sliding in a vertical direction and the other set sliding in a horizontal direction.

9. Apparatus according to claim 2, wherein the loading and unloading means comprises two carriages each equipped with a removal spindle and a positioning spindle identical to the removal spindle, one of said carriages sliding in a vertical direction and the other of said carriages sliding in a horizontal direction.

10. Apparatus according to claim 9, wherein the transfer carriage carrying the capture head and the nozzle as well as the two carriages of the loading and unloading means are mounted in a framework which slides horizontally in a second framework which slides vertically in a third framework and which is held fixed at the working position.

11. Apparatus according to claim 10, wherein the frame is provided with bolts for positioning and immobilizing the bobbin-changing device in the bobbin-changing position.

12. Apparatus according to claim 2, wherein the components of the bobbin-changing device are actuated by drive means controlled by an automatic sequence.

13. Apparatus according to claim 12, wherein the drive means for components of the bobbin-changing device consists of jacks.

14. Apparatus according to claim 13, wherein said jacks comprise a single-action jack drawn back by a spring for actuating the claws of the removal spindle and double-action jacks for actuating the other components, and the means for carrying out the automatic sequence comprise a pneumatic distributor with a memory, associated with each double-action jack, alternately controlling the supply to each side of the chamber of the corresponding jack.

15. Apparatus according to claim 14, wherein the automatic sequence for controlling the drive means is connected to an automatic sequence characteristic of the bobbin-winder.

16. Apparatus according to claim 2, comprising *n* yarn supports per winding up position located around the winding cylinder, wherein the means for mounting the nozzle permits the latter to move between *n* positions for taking up the yarn and *n* positions for anchoring the yarn on the *n* supports, and the unloading and loading means occupies *n* working positions opposite the *n* yarn supports.

17. Apparatus according to claim 2, wherein the capture and removal nozzle comprises an elongated nozzle body provided with a longitudinal yarn passage, the cross-section of which has a surface area which increases from the upstream towards the downstream end, and with a longitudinal slit which extends along a generatrix of the passage over the greater part of the length of the latter and provides communication between the passage and the exterior, said nozzle having a nozzle head which has at least two pipelines for supplying gaseous fluid, positioned in a direction substantially parallel to the axis of the yarn passage and opening into the latter, and a slit to enable the yarn to pass from the exterior into the yarn passage.

18. Apparatus according to claim 17, wherein the means for cutting the yarn consist of blade means, the cutting part of said blade means being renewable after each cutting operation, said blade means being mounted on the nozzle body adjacent to the capture slit.

19. Apparatus according to claim 18, including pneumatic means for detecting the presence of the yarn in the nozzle which is mounted upstream from the nozzle and is firmly fixed to the latter.

20. Apparatus according to claim 2, wherein the removal spindle comprises a tube, the external diameter of which corresponds to the internal diameter of the yarn support, and which is provided with at least one longitudinal slit extending along a generatrix over its entire length, a slide-bar which is positioned inside the tube and which carries at least one claw which can expand radially through the slit, and a stop which is firmly fixed to the slide-bar and which projects through the slit.

21. Apparatus according to claim 2, wherein the spindle for placing an empty support in position comprises a tube, the internal diameter of which corresponds to the external diameter of the yarn support, and a sliding push-rod positioned inside the tube.

* * * * *